US006991191B2

(12) United States Patent
Reed et al.

(10) Patent No.: US 6,991,191 B2
(45) **Date of Patent: *Jan. 31, 2006**

(54) METHOD OF USING A SMALL SCALE MILL

(75) Inventors: Robert Gary Reed, Birdsboro, PA (US); David A. Czekai, Spring City, PA (US); Henry William Bosch, Bryn Mawr, PA (US); Niels-Peter Moesgaard Ryde, Malvern, PA (US)

(73) Assignee: Elan Pharma International, Limited, Dublin (IE)

( * ) Notice: Subject to any disclaimer, the term of this patent is extended or adjusted under 35 U.S.C. 154(b) by 30 days.

This patent is subject to a terminal disclaimer.

(21) Appl. No.: 10/833,045

(22) Filed: Apr. 28, 2004

(65) Prior Publication Data

US 2004/0251332 A1 Dec. 16, 2004

Related U.S. Application Data

(60) Continuation of application No. 10/037,566, filed on Oct. 19, 2001, now Pat. No. 6,745,962, which is a division of application No. 09/583,893, filed on May 31, 2000, now Pat. No. 6,431,478.

(60) Provisional application No. 60/137,142, filed on Jun. 1, 1999.

(51) Int. Cl.
*B02C 17/16* (2006.01)

(52) U.S. Cl. ..... 241/21; 424/489

(58) Field of Classification Search ..... 241/21, 241/23, 172; 424/489

See application file for complete search history.

(56) References Cited

U.S. PATENT DOCUMENTS 4,848,676 A 7/1989 Stehr (Continued)

FOREIGN PATENT DOCUMENTS

EP 0483808 A1 5/1992

(Continued)

OTHER PUBLICATIONS

PCT International Search Report based on Appl. No. PCT/US00/014705.

Reinsch et al., "Energy Consumption for Wet Grinding in Stirred Mills," *Aufbereitungs-Technik*, 38(1997) 3, pp. 152-160.

(Continued)

*Primary Examiner*—Mark Rosenbaum
(74) *Attorney, Agent, or Firm*—Foley & Lardner LLP

(57) ABSTRACT

A small-scale or micro media-mill and a method of milling materials or products, especially pharmaceutical products, use a dispersion containing attrition milling media and the product to be milled. The milling media can be polymeric, formed of polystyrene or cross-linked polystyrene, having a nominal diameter of no greater than 500 microns. Other sizes include 200 microns and 50 microns and a mixture of these sizes. The mill has a relatively small vessel having an opening, an agitator, a coupling and a motor. The agitator can have a rotor and a shaft extending therefrom. The rotor can be cylindrical or have other configurations, and can have tapered end surfaces. The coupling can close the vessel opening, or attaching the coupling to the motor can close the opening. The coupling has an opening through which the rotor shaft extends into the motor. A sealing mechanism, such as a mechanical or lip seals the shaft while permitting the rotor shaft to rotate. The vessel can contain one or more ports for circulating the dispersion, where milling can be made in batches or recirculated through the milling chamber. The media can be retained in the vessel or recirculated along with the process fluid. The rotor is dimensioned so that its outer periphery is spaced with a small gap from an inner surface of the vessel. The vessel also can have a way of cooling the dispersion.

60 Claims, 12 Drawing Sheets

U.S. PATENT DOCUMENTS

| | | | |
|---|---|---|---|
| 5,133,506 | A | 7/1992 | Bogen |
| 5,145,684 | A | 9/1992 | Liversidge et al. |
| 5,183,215 | A | 2/1993 | Getzmann |
| 5,464,163 | A | 11/1995 | Zoz |
| 5,518,187 | A | 5/1996 | Bruno et al. |
| 5,593,097 | A | 1/1997 | Corbin |
| 5,718,388 | A | 2/1998 | Czekai et al. |
| 5,797,550 | A | 8/1998 | Woodall et al. |
| 5,862,999 | A | 1/1999 | Czekai et al. |

FOREIGN PATENT DOCUMENTS

| | | | |
|---|---|---|---|
| EP | 0686428 | A1 | 12/1995 |

OTHER PUBLICATIONS

The et al., "Autogenous Grinding of SIC in Stirred Mills with- out and with Grinding Aids, Part 1," *Aufbereitungs-Technik*, 33(1992) 10, pp. 541-549.

Joost et al., "Feinstzerkleinerung in Rührwerkmühien," *Das Jehrbuch der Keramik*, Reh, H., Bauverlag, Walluf, 1995, pp. 23-38.

Stadler et al., "Nassmahlung in Rührwerksmühien," *Chem.-ing.-Tech.*, 82(1990) 11, pp. 907-915.

Kwade et al., "Motion and Stress intensity of grinding beads in a stirred media mill. Part 2: Stress intensity and its effect on comminution," *Powder Technology*, 86(1996), pp. 69-76.

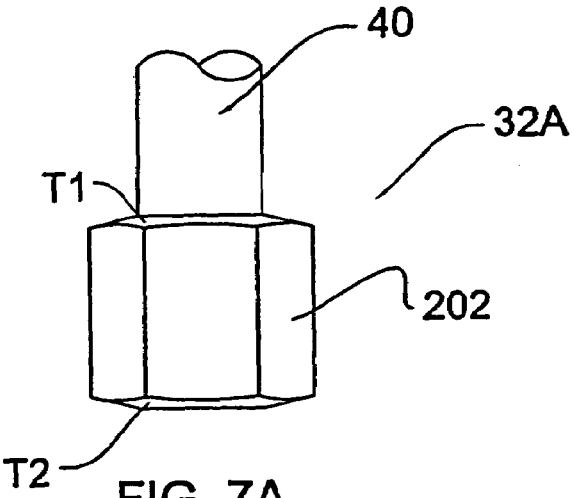
FIG. 7
FIG. 7A
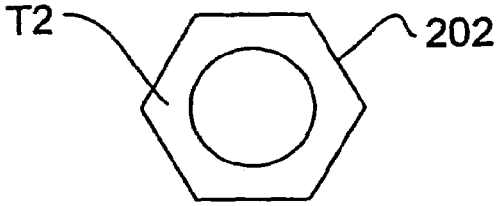
FIG. 8
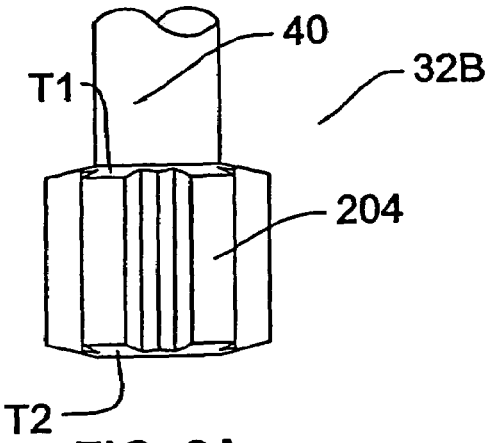
FIG. 8A
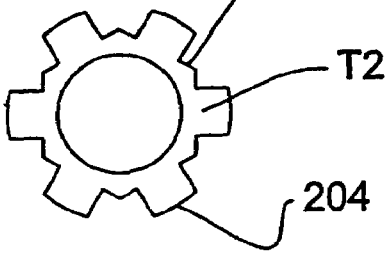
FIG. 9
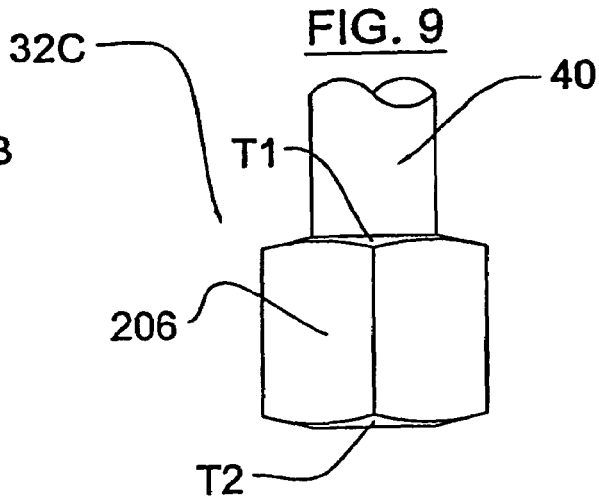
FIG. 9A
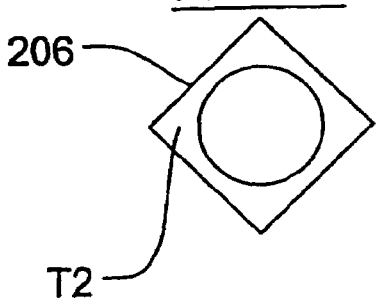

FIG. 10
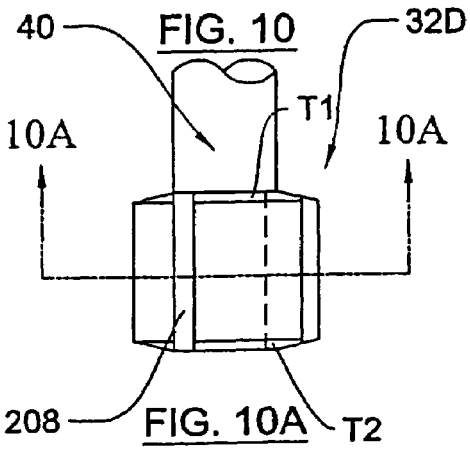
FIG. 10A
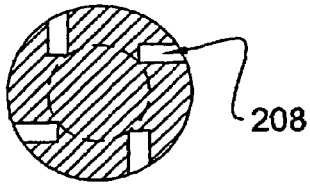
FIG. 11
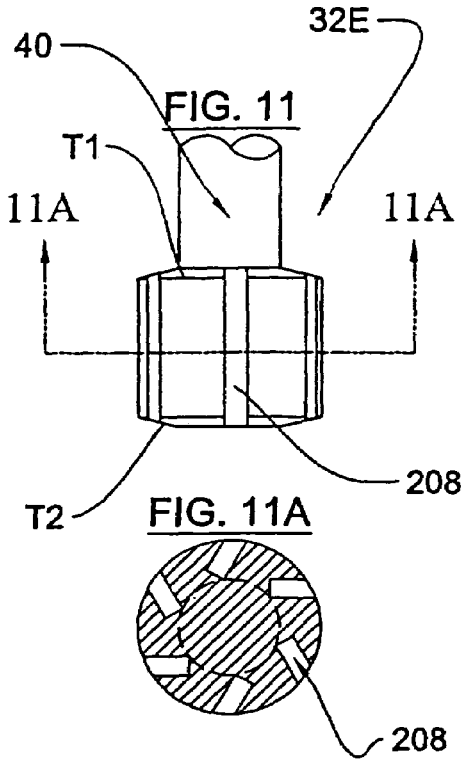
FIG. 11A
FIG. 12
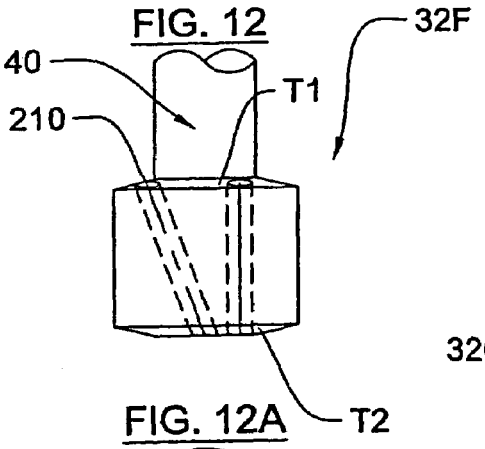
FIG. 12A
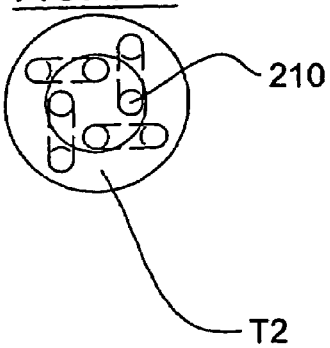
FIG. 13
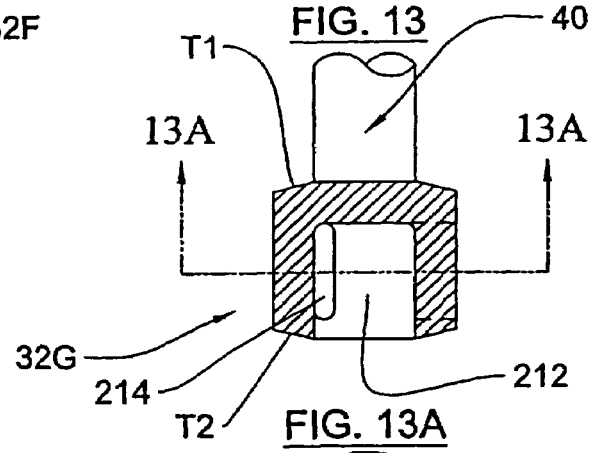
FIG. 13A
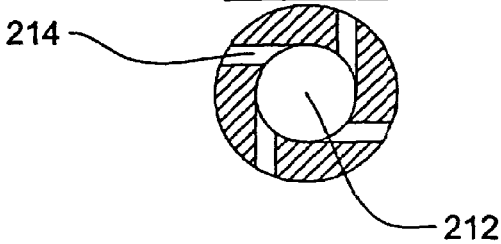

METHOD OF USING A SMALL SCALE MILL

RELATED APPLICATIONS

This application is a continuation of application Ser. No. 10/037,566, filed on Oct. 19, 2001, now U.S. Pat. No. 6,745,962, which is a divisional of application Ser. No. 09/583,893, filed on May 31, 2000, now U.S. Pat. No. 6,431,478, which is based on Provisional Application No. 60/137,142, filed on Jun. 1, 1999, the disclosures of which are specifically incorporated by reference.

BACKGROUND

Wet media mills, such as the ones described in U.S. Pat. No. 5,797,550 issued to Woodall, et al, and U.S. Pat. No. 4,848,676 issued to Stehr, are generally used to mill or grind relatively large quantities of materials. These rather large media mills are not generally suitable for grinding small or minute quantities. U.S. Pat. No. 5,593,097 issued to Corbin recognizes the need for milling small quantities, as small as 0.25 grams, to a size less than 0.5 micron to about 0.05 micron in terms of average diameter in about 60 minutes.

The media mill described in the Corbin patent comprises a vertically oriented open top vessel, a vertically extending agitator with pegs, a motor for rotating the agitator, and a controller for controlling the rotational speed. The vessel is a cylindrical centrifuge or test tube formed of a glass, plastic, stainless steel, or other suitable material having an inner diameter of between 10 to 20 mm. The media suitable is described as any non-contaminating, wear resistant material, sized between about 0.17 mm to 1 mm in diameter.

The particulates to be ground and the grinding media are suspended in a dispersion and poured into the vessel. The agitator, with the peg end inserted in the vessel, is spun. The Corbin patent also discloses that the pegs should extend to within between about 1–3 mm of the sides of the vessel to provide the milling desired in the shortest possible time without damaging the materials and producing excessive heat. To avoid splattering created by vortexing of the material during mixing, the top peg of the mixer is positioned even with the top of the dispersion. No seal or cover is deemed needed during mixing or agitation if this practice is followed.

The Corbin patent also discloses that its micro media can be useful for forming medicinal compounds, food additives, catalysts, pigments, and scents. Medicinal or pharmaceutical compounds can be expensive and require much experimentation, with different sizes and quantities. The Corbin patent discloses that the preferred media for medicinal compounds are zirconium oxide and glass. Moreover, pharmaceutical compounds are often heat sensitive, and thus must be maintained at certain temperatures. In this respect, the Corbin patent discloses using a temperature control bath around the vessel.

In the media mill of the type described in the Corbin patent, even if the vessel is filled to the top peg, however, the rotating agitator in the dispersion creates a vortex, which undesirably draws air into the dispersion and foams the dispersion. Moreover, the open top configuration draws in contamination, making the mill unsuitable for pharmaceutical products. The temperature-controlled bath could spill into the open top container and further contaminate the product.

There is a need for a micro or small-scale media mill that avoids these problems. The present invention is believed to meet this need.

SUMMARY

The present invention relates to a small-scale or micro media-mill and a method of milling materials, such as pharmaceutical products. The present small-scale mill, which can be vertically or horizontally oriented, can use a dispersion containing attrition milling media and the product to be milled. The milling media can be polymeric type, such as formed of polystyrene or cross-linked polystyrene having a nominal diameter of no greater than 500 microns. Other sizes include 200 microns and 50 microns and a mixture of these sizes.

In one embodiment, the mill has a relatively small vessel having an opening, an agitator, and a coupling, and a rotatable shaft mounted for rotation about a shaft mount. The agitator is dimensioned to be inserted in the vessel through the opening. Specifically, the agitator can have a rotor and a rotor shaft extending from the rotor. The rotor shaft is connected to the rotatable shaft. The rotor is dimensioned to be inserted in the vessel with a small gap formed between an outer rotating surface of the rotor and an internal surface of the vessel. The coupling detachably connects the vessel to the shaft mount. The coupling has an opening through which a portion of the agitator, such as the rotor shaft, extends. The shaft mount seals the vessel opening to seal the dispersion in the vessel. A seal can be provided to seal the portion of the agitator or the rotor shaft while permitting the agitator to rotate. The rotatable shaft can be driven by a motor or can be a motor shaft of a motor, preferably a variable speed motor capable of 6000 RPM.

In one embodiment; the coupling can have a threaded portion for detachably mounting to the shaft mount and a flange portion for detachably coupling to the vessel. In another embodiment, the coupling is integrally formed with the vessel and has a threaded portion for detachably mounting to the shaft mount.

The mill can include a cooling system connected to the vessel. In one embodiment, the cooling system can comprise a water jacket. Specifically, the vessel comprises a cylindrical inner vessel and an outer vessel spaced from and surrounding the inner vessel. The inner and outer vessels form a chamber therebetween. The chamber can be vessel shaped or annular. A flange connects the upper ends of the inner and outer vessel. The outer vessel (jacket) has at least first and second passages that communicate with the chamber. The cooling system comprises the outer vessel with the first and second passages, which is adapted to circulate cooling fluid.

In an alternative embodiment, the vessel can comprise an inner cylindrical wall having a bottom and an open top and an outer cylindrical wall spaced from and surrounding the inner vessel. The inner and outer cylindrical walls are connected together so that an annular chamber is formed therebetween. At least the first and second passages are formed at the outer cylindrical wall and communicate with the chamber to pass coolant. The bottom extends radially and covers the bottom end of the outer cylindrical wall. The bottom can have an aperture that allows samples of the dispersion to be withdrawn. A valve can close the aperture. Alternatively, the bottom can have an observation window for observing the dispersion.

In another embodiment, the vessel can include at least one port through which the dispersion is filled. The vessel includes at least two ports through which the dispersion is circulated. In this respect, the cooling system comprises the ports on the vessel for circulating the dispersion. The vessel can be horizontally oriented.

The rotor can be cylindrical, and can have tapered end surfaces. In one embodiment, the rotor is dimensioned so that its outer periphery is spaced no larger than 3 mm away from an inner surface of the vessel, particularly when the dispersion contains attrition media having a nominal size of no larger than 500 microns. The spacing or the gap is preferably no larger than 1 mm, particularly when the dispersion contains attrition media having a nominal size of no larger than 200 microns.

In another embodiment, the cylindrical rotor can have a cavity and a plurality of slots that extend between an inner surface of the cavity and an outer surface of the cylindrical rotor. In another embodiment, the cylindrical rotor can have a plurality of channels extending to an outer surface of the cylindrical rotor. In another embodiment, the cylindrical rotor can have a plurality of passageways extending between the tapered end surfaces of the cylindrical rotor.

One method according to the present invention comprises providing a dispersion containing a non-soluble product to be milled and attrition milling media having a nominal size of no greater than 500 microns; inserting the dispersion into a cylindrical vessel; providing an agitator and a coupling that closes the vessel, the coupling having an opening through which a portion of the agitator extends, the agitator comprising a cylindrical rotor and a shaft extending therefrom, wherein the cylindrical rotor is dimensioned so that an outer periphery is no greater than 3 mm away from an inner surface of the cylindrical wall; inserting an agitator into cylindrical vessel and sealingly closing the coupling, wherein the amount of dispersion inserted into the vessel is so that the dispersion eliminates substantially all of the air in the vessel when the agitator is fully inserted into the vessel; and rotating the agitator for a predetermined period.

Another method according to the present invention comprises providing a dispersion containing a non-soluble product to be milled and attrition milling media having a nominal size of no greater than 500 microns; providing an agitator having a cylindrical rotor and shaft extending therefrom; inserting the agitator in a horizontally oriented cylindrical vessel and sealing the cylindrical vessel, the cylindrical rotor being dimensioned to provide a gap of no greater than 3 mm between an outer surface of the rotor and an inner surface of the vessel; providing at least one port through the cylindrical vessel and maintaining the port at a highest point of the horizontally oriented cylindrical vessel; filling the cylindrical vessel with the dispersion until the dispersion drives out substantially all of the air in the vessel; and rotating the agitator for a predetermined period.

The method further includes cooling the vessel by jacketing the vessel and flowing water between the jacket and the vessel. Another method comprises externally circulating the dispersion through a plurality of ports formed through the horizontally oriented vessel to thereby cool the dispersion or refresh the dispersion.

BRIEF DESCRIPTION OF THE DRAWINGS

These and other features, aspects, and advantages of the present invention will become more apparent from the following description, appended claims, and accompanying exemplary embodiments shown in the drawings.

FIG. 7–13D illustrate various agitator configurations that can be used with the media mill of FIGS. 1–4.

DETAILED DESCRIPTION

Although references are made below to directions in describing the structure, they are made relative to the drawings (as normally viewed) for convenience. The directions, such as top, bottom, upper, lower, etc., are not intended to be taken literally or limit the present invention.

A small-scale mill 1, 1A, 2 (FIGS. 1–4) according to the present invention is designed to mill relatively small amounts of dispersion to a size ranging from microns to nanometers in a relatively short time, i.e., a few hours or less, using attrition milling media, such as polymer type, e.g., cross linked polystyrene media, having nominal size no greater than about 500 microns (0.5 mm) to about 50 microns or mixtures of the sizes ranging between them. The performance of the present scale mill is designed to provide the results comparable to the DYNO-MILL and the NETZSCH ZETA mills. The mill 1, 1A, 2 according to the present invention can have a provision for cooling the dispersion, which allows increased agitator tip speed without overheating, to increase its efficiency and allow milling of heat sensitive pharmaceutical products.

Figure 5:
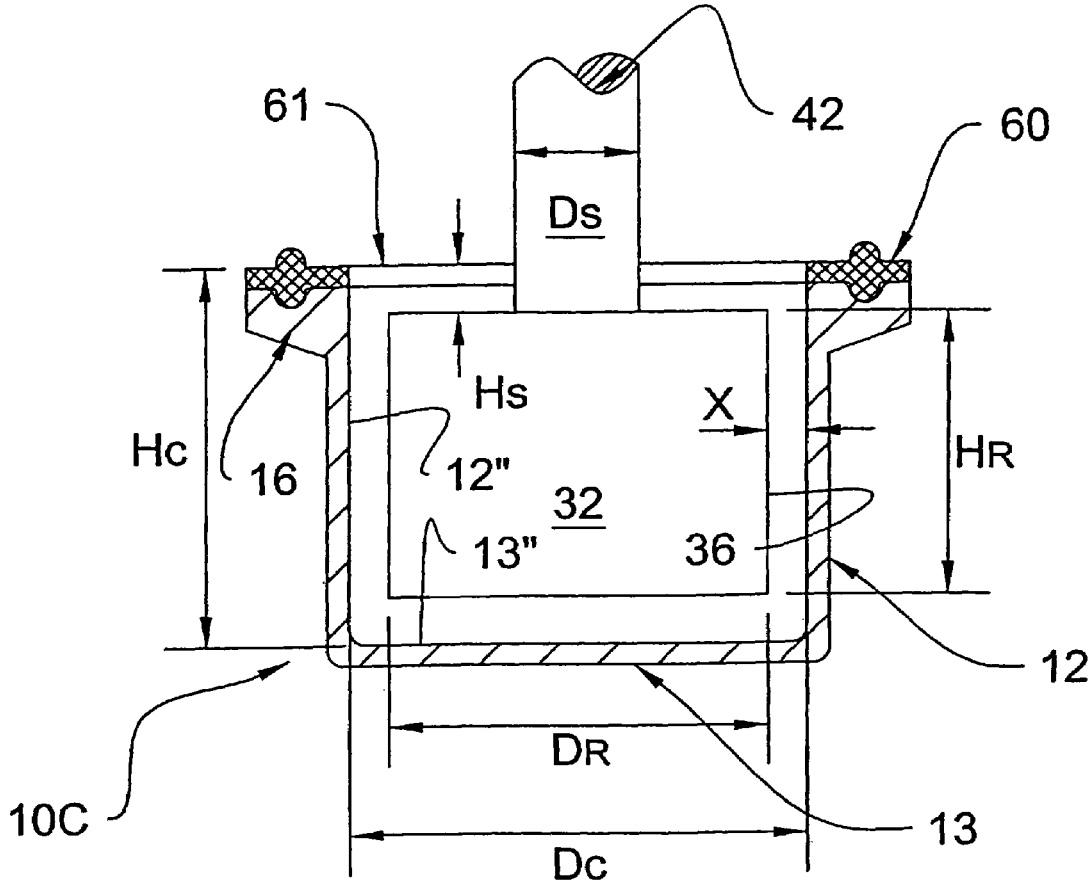
FIG. 5 illustrates another embodiment of an agitator and another embodiment of a vessel that can be used with the media mill of FIGS. 1–4.
Figure 6:
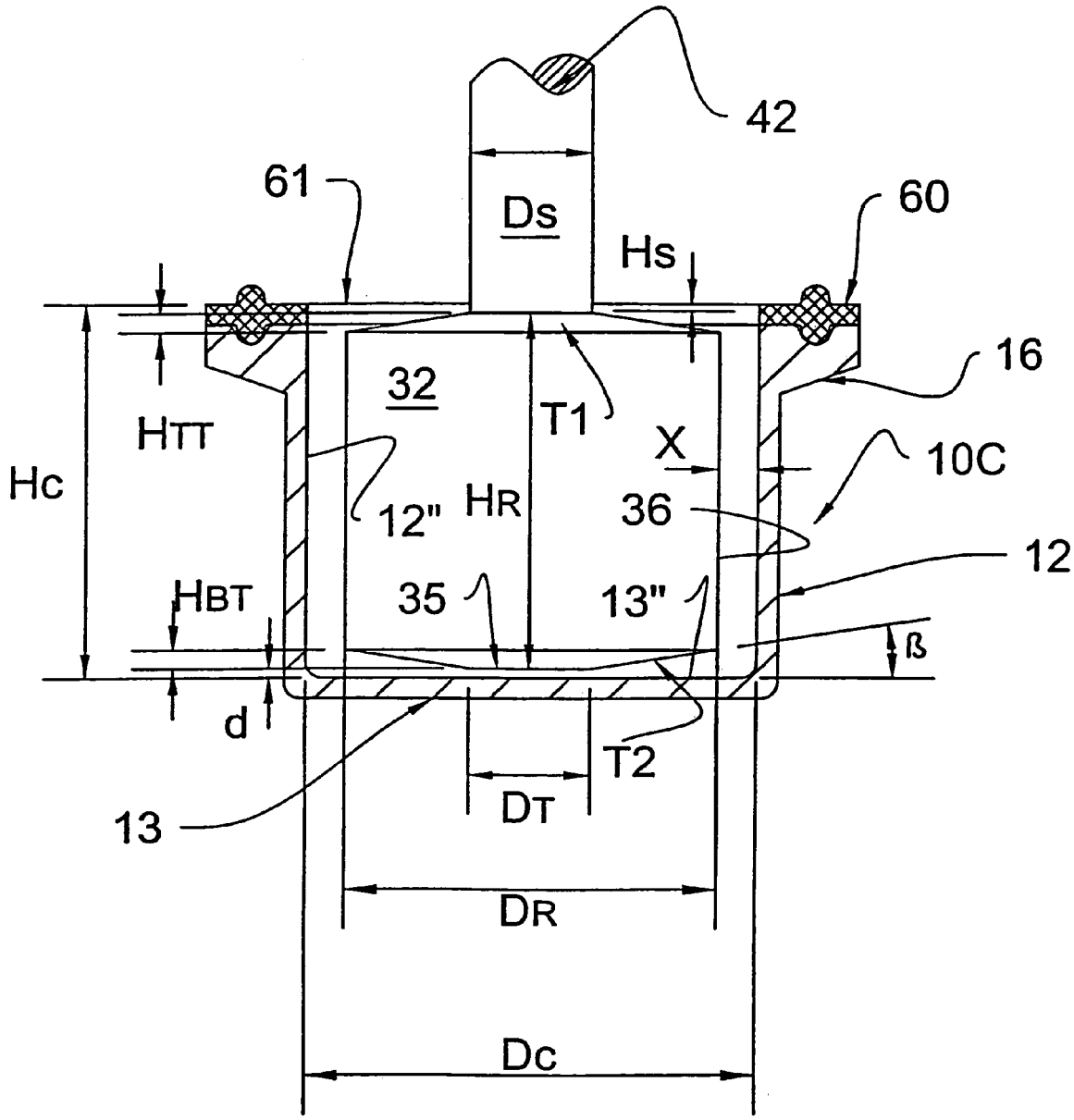
FIG. 6 illustrates the agitator of the type illustrated in the embodiments of FIGS. 1–4.

A vertically oriented mills 1, 1A is exemplified in FIGS. 1–3A. The mill 1, 1A generally comprises a container or vessel 10, 10A, 10B, 10C, an agitator or mixer 30, a coupling 50, and a rotatable journaled shaft 120, which can be that of a motor 100. The vessel 10, 10A, 10B, 10C has a substantially cylindrical milling chamber and can be single walled 10C, as shown in FIGS. 5 and 6, or jacketed (double-walled) 10, 10A, 10B, as shown in FIGS. 1–3A, to allow water cooling. The agitator 30, which comprises a rotor 32 and a shaft 40 extending from one end of the rotor 32, is preferably a single piece to ease cleaning, and is adapted to be connected to a conventional electric motor 100, which preferably is capable of rotating up to 6000 RPM. A conventional motor controller 101 (FIGS. 1, 3, 4), such as SERVODYNE Mixer Controller available from Cole-Parmer Instrument Co. of Vernon Hills, Ill., can control the motor speed and duration. The coupling 50 is mounted to the motor 100 and is coupled to the vessel 10 using a sanitary fitting and a clamp C (shown in phantom in FIG. 3) to seal the vessel 10, 10A, 10B, 10C.

Figure 1:
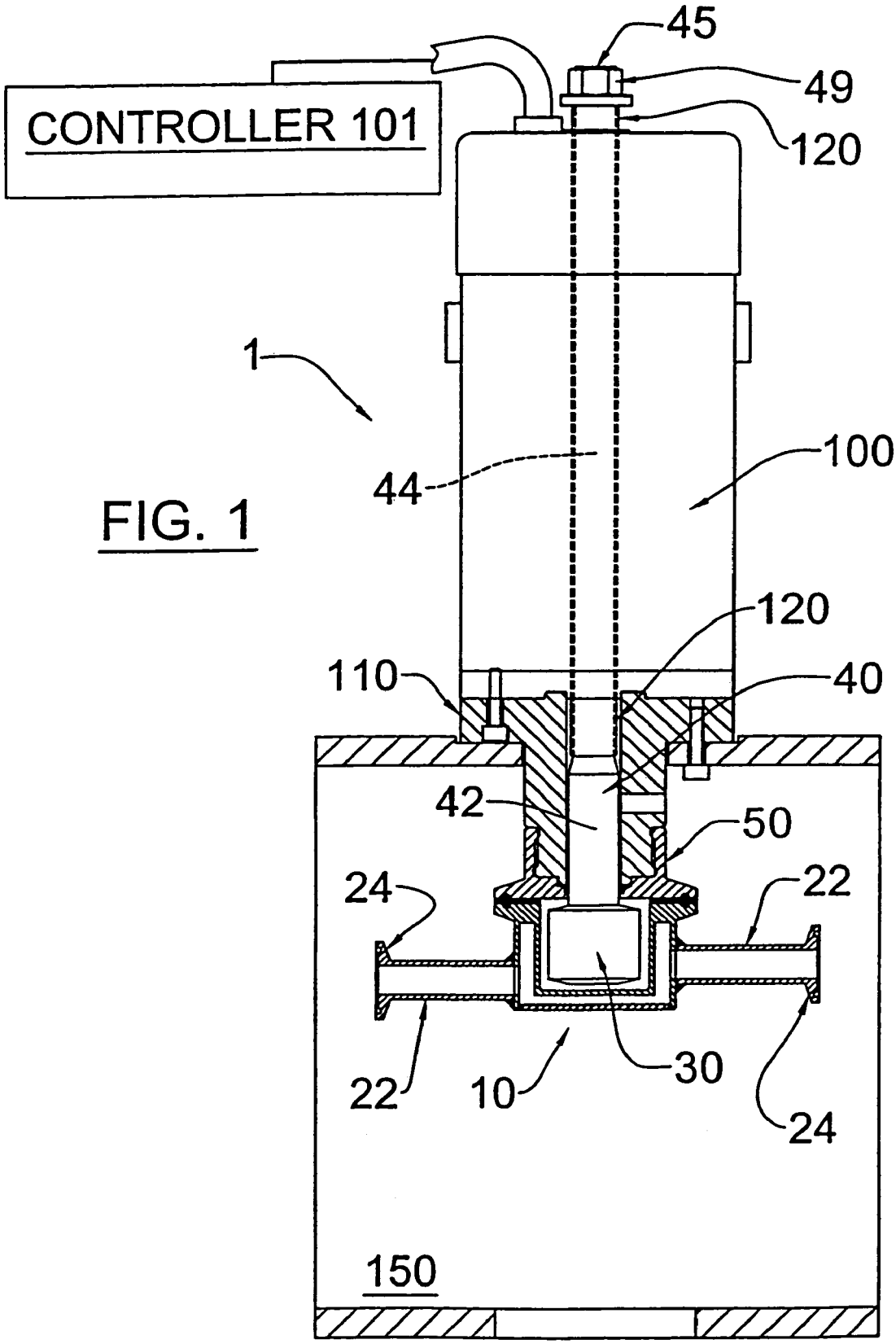
FIG. 1 illustrates a small-scale or micro-media mill according to one embodiment of the present invention.
Figure 1A:
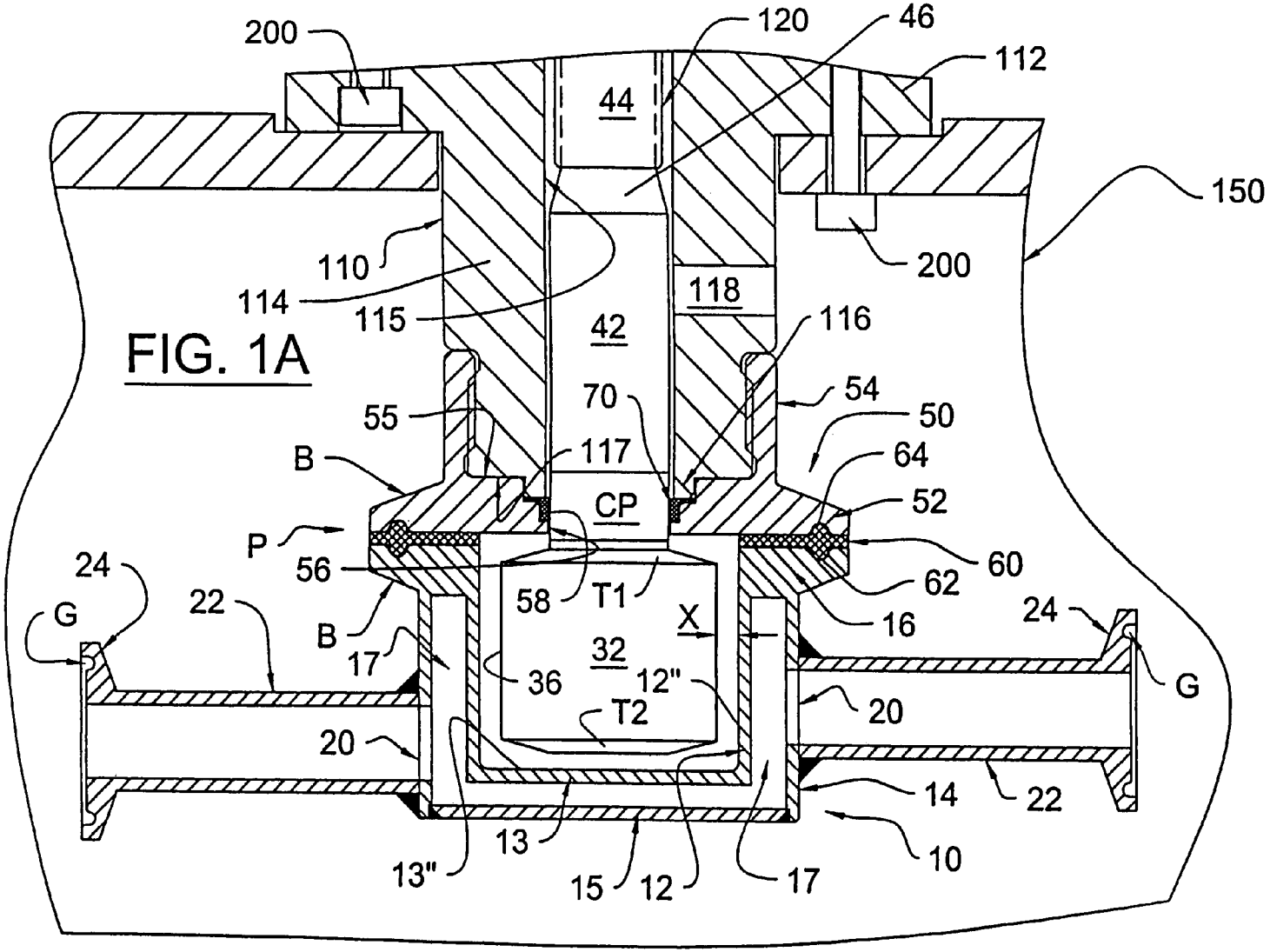
FIG. 1A illustrates an enlarged detailed view of the mill shown in FIG. 1.

Referring to FIG. 1A, the vessel 10 in this embodiment is double walled or jacketed to circulate a coolant. Specifically, the vessel 10 comprises an inner cylindrical wall 12 and an outer cylindrical wall 14 spaced from and concentric with the inner cylindrical wall 12. The outer wall 14, however, need not be cylindrical or concentric relative to the inner wall 12. It can have any configuration that allows water circulation to the inner cylindrical wall 12. An annular mounting flange 16 holds together top end of the inner and outer cylindrical walls 12, 14. The inner cylindrical wall 12 has a bottom wall 13 enclosing its bottom end to form an inner vessel (12, 13). The outer cylindrical wall 14 also has a bottom wall 15 enclosing its bottom end and spaced from the bottom wall 13 to form an outer vessel (14, 15). The outer vessel (14, 15) is spaced from the inner vessel (12, 13) and forms a vessel shaped chamber 17 that can be filled with water and circulated to cool the dispersion during milling.

The outer cylindrical wall 14 has two openings 20, preferably positioned diametrically opposite to each other and a pair of coolant connectors 22 aligned with the openings 20. Either of these connectors 22 can serve as a coolant inlet or outlet. These connectors 22 can extend substantially radially outwardly. The free end of each connector can have a sanitary fitting, which includes an annular mounting flange 24 and a complementary fitting (essentially mirror image thereof—not shown), adapted to be clamped with, for example, a TRI-CLAMP available from Tri-Clover Inc. of Kenosha, Wis. These mounting flanges 24 are configured substantially similar to the mounting flanges 16, 52 connecting the vessel 10, 10A, 10B, 10C to the motor 100. All of these mounting flanges 16, 24, 52 can be adapted for a TRI-CLAMP, as described below. Each of these flanges 16, 24, 52 has an annular groove G for seating an annular gasket 60 and a beveled or tapered surface B. The mounting flanges and the gasket 60, which is FDA approved, adapted for the TRI-CLAMP are also available from Tri-Clover Inc.

Figure 2:
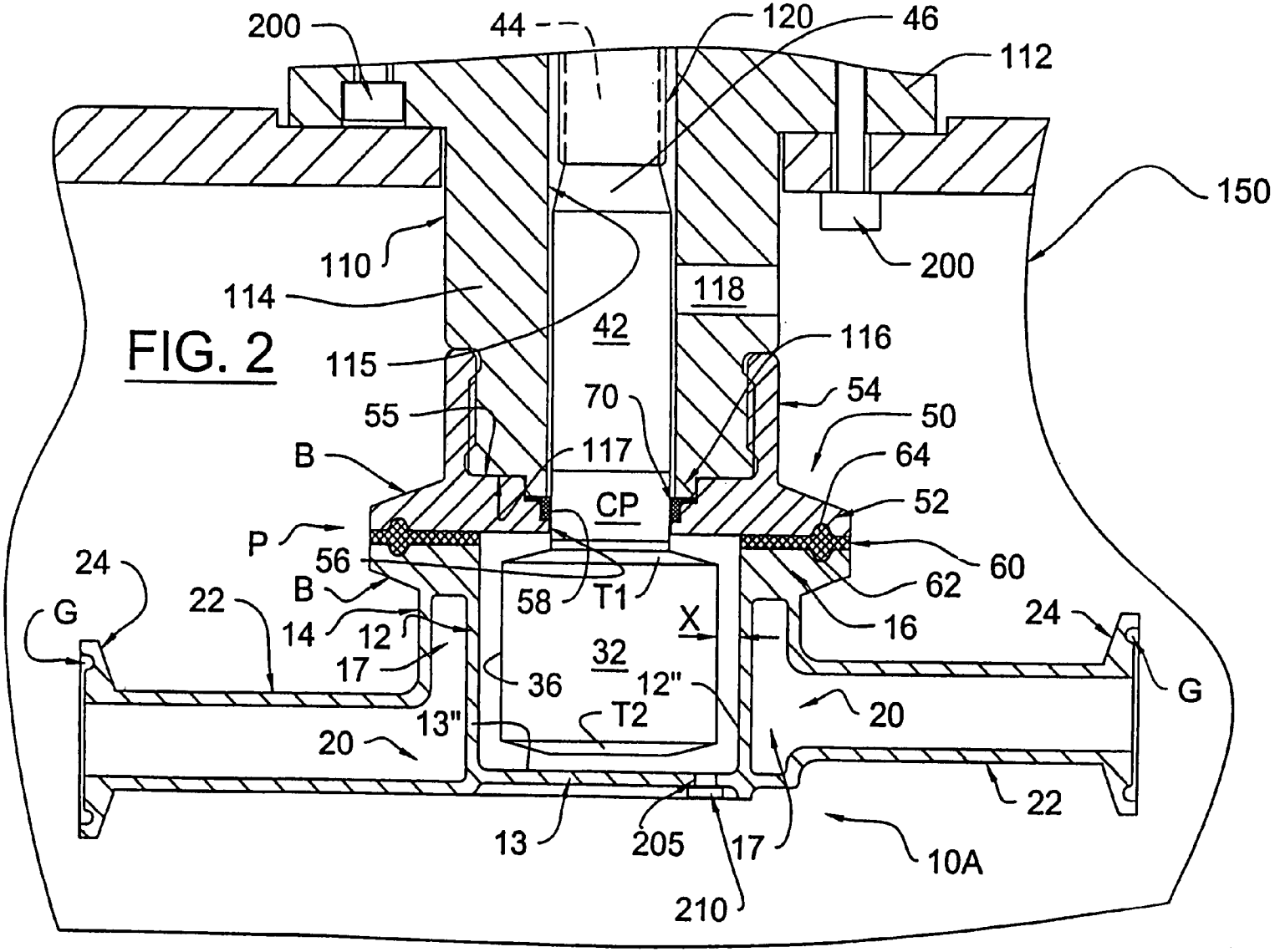
FIG. 2 illustrates the media mill of FIG. 1, but with a different vessel.

FIG. 2 shows another embodiment of the double walled vessel 10A, which is substantially similar to that shown in FIGS. 1 and 1A. The difference is that the bottom wall 13 of the inner cylindrical wall 12 in FIG. 2 is exposed. In other words, the alternative vessel 10A of FIG. 2 has no outer bottom wall 15 of FIG. 1A. The alternative vessel 10A has its bottom wall 13 extending radially outwardly to the outer cylindrical wall 14. The chamber 17 is annular instead of being vessel shaped (FIG. 2). The bottom wall 13 can have a heat sink or a Peltier coolant (not shown) attached. The bottom wall 13 also can have an observation window or an opening 205, which can be sealed or can have a valve 210 that vents excess pressure build up and/or allows a sample withdrawal. This way, minute amounts of dispersion can be taken out and examined without having to take off the coupling 50. Alternatively, the opening can be sealed using a self-sealing resilient material that permits insertion of a syringe for withdrawing samples. The window 205 can have a small chamber extending outwardly from the bottom (not shown). This chamber can hold a small amount of dispersion so that it can be viewed through an observation device. This chamber can be configured so that the dispersion is constantly circulated, such as placing the window 205 in a location where the dispersion is constantly moving.

Figure 3:
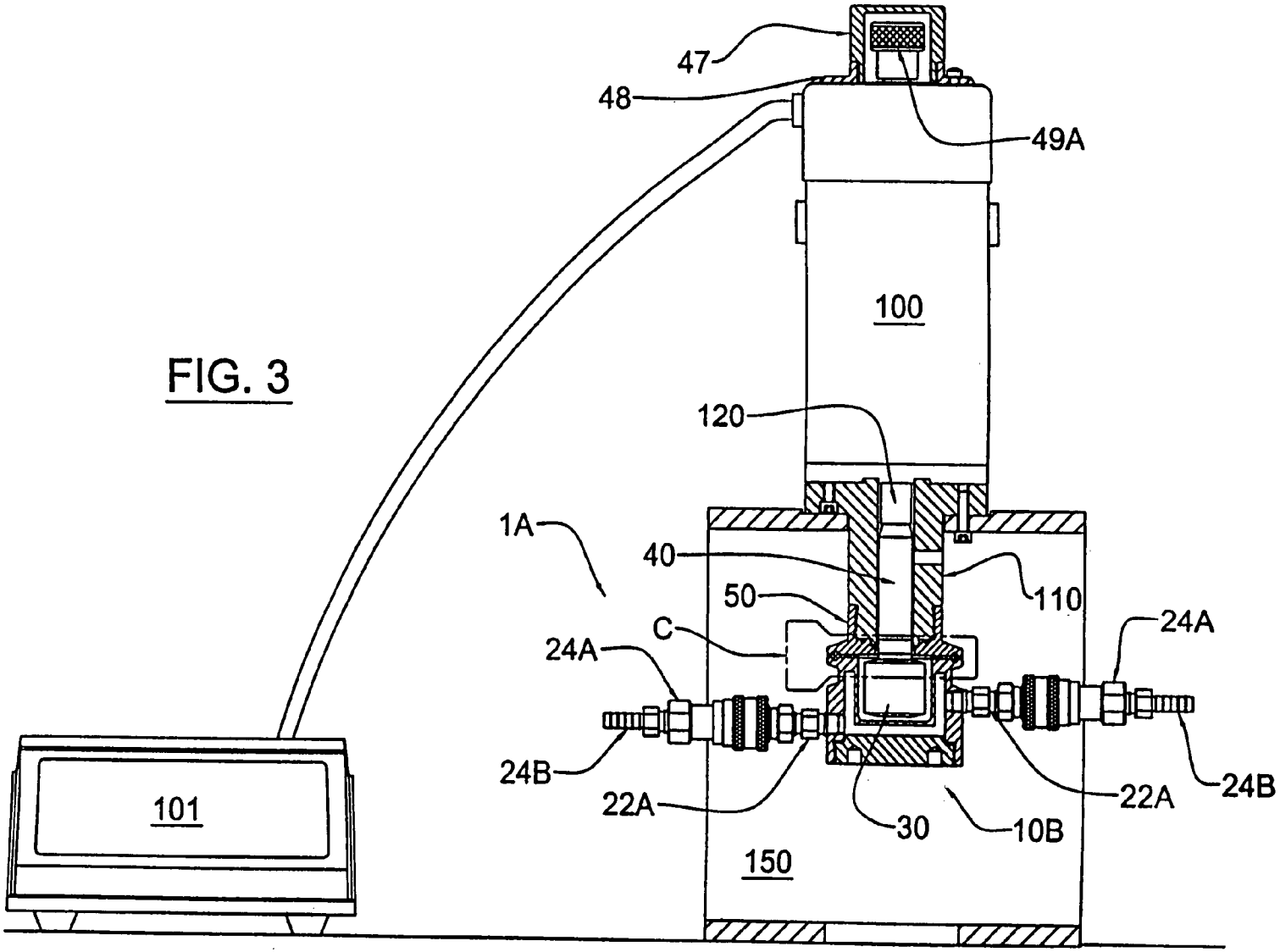
FIG. 3 illustrates a small-scale or micro-media mill according to another embodiment of the present invention.
Figure 3A:
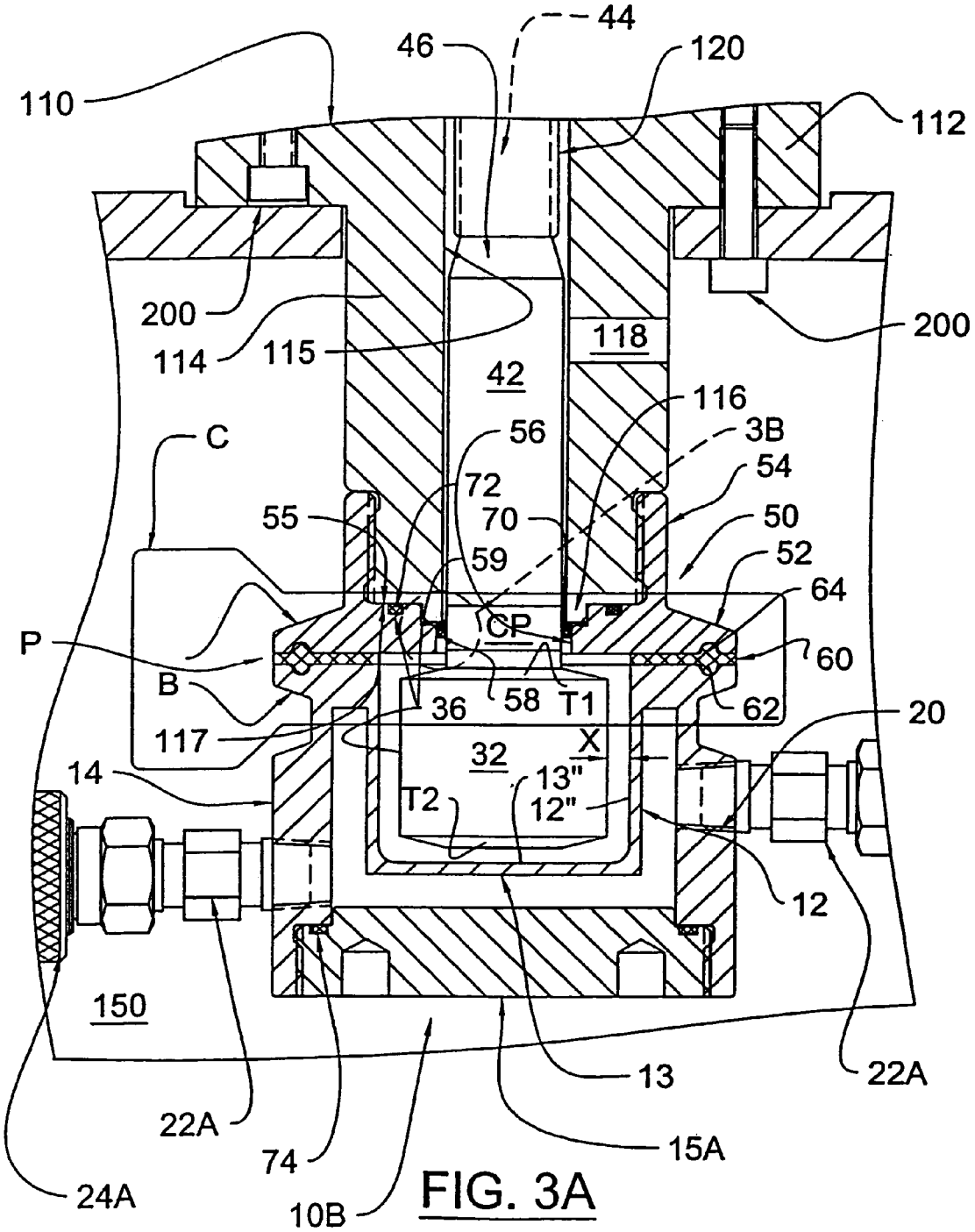
FIG. 3A illustrates an enlarged detailed view of the mill shown in FIG. 3.

FIGS. 3 and 3A show another embodiment of the double walled vessel 10B, which is substantially similar to that shown in FIGS. 1 and 1A. The primary difference is that the outer bottom wall 15A can be threaded or screwed (or sealingly mounted) into the outer cylindrical wall 14. In this respect, the outer bottom wall 15A can have an annular groove (not numbered) that seats an O-ring 74 or the like to provide a better water seal. Another difference from the vessel of FIGS. 1 and 1A, is that a quick couple fitting 22A, 24A, 24B is used. The connectors 22A are threadlingly mounted to the openings 20 formed in the outer cylindrical wall 14. The connectors 22A can use a commercially available quick connector or couple 24A, such as ⅛" PARKER series 60 Quick Couple. The quick couple 24A can be connected to a flexible hose barb 24A, such as a commercially available stainless steel ⅛" NPT×¼" hose barb. The double-walled vessels 10 and 10A can also use the quick couple fitting 22A, 24A, 24B instead of the sanitary fitting type described above and illustrated in FIGS. 1–2.

Alternative to the double walled vessel is a single walled vessel 10C shown in FIGS. 5 and 6. The single walled vessel 10C can be used when the product to be milled is not heat sensitive or for milling a short period. The single walled vessel is constructed similar to the inner vessel (12, 13) of the double walled vessel 10. A heat sink (not shown) can be attached to its cylindrical wall 12 and bottom wall 13. The heat sink also can be fan cooled. Another alternative cooling system can be a Peltier cooler, which operates on the Peltier effect theory (cooling by flowing an electric current through a Peltier module made of two different types of conductive or semiconductive materials attached together). A Peltier module with a heat sink (Peltier coolant) can be detachably attached to the vessel.

In the embodiments of FIGS. 1–3, 5, and 6, the mounting flange 52 of the coupling 50 is configured substantially the same as or complementary to the annular mounting flange 16. The mounting flanges 16 and 52 are coupled facing each other with the gasket 60, such as a Tri-Clamp EPDM black, FDA approved gasket, sandwiched therebetween, as shown in FIGS. 1A, 2, and 3A. The gasket 60 has annular lower 62 and upper 64 protrusions that engage the respective grooves G formed in the mounting flanges 16, 52, and align the flanges 16 and 52. A TRI-CLAMP C (see FIG. 3) can engage the periphery P and the beveled surfaces B of the mounting flanges 16, 52. When these flanges are aligned, they form a trapezoidal profile. Tightly wrapping the TRI-CLAMP around the periphery and the beveled surfaces B squeezes the flanges 16, 52 together to provide a sealed connection.

The mounting flanges 24 of the connectors 22 (FIGS. 1, 1A, 2) can be connected to their respective water source and drain pipes (not shown) in the same way as the vessel 10, 10A, 10B, 10C is connected to the coupling 50, as just described, using a gasket 60 and a TRI-CLAMP C.

Figure 3B:
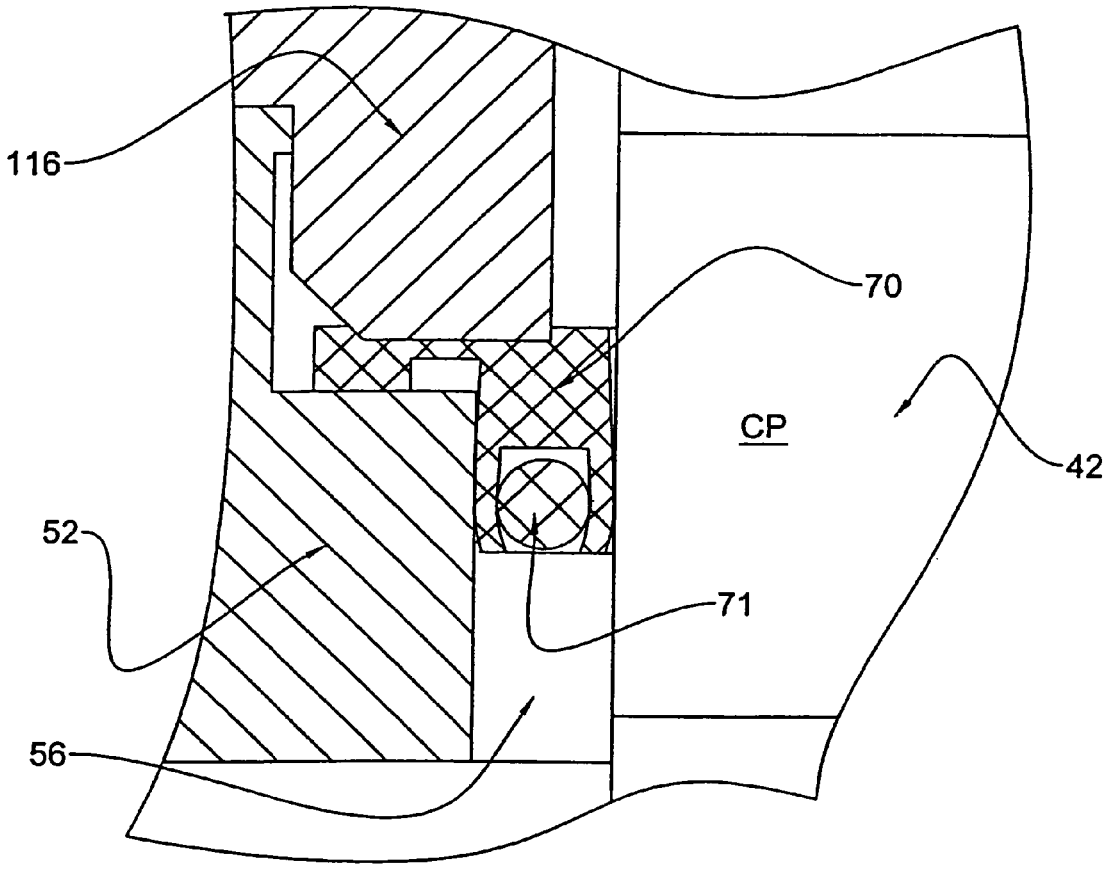
FIG. 3B illustrates an enlarged detailed view taken along area 3B of FIG. 3A.

Referring to the embodiments of FIGS. 1–3A, the coupling 50 also has a cylindrical portion 54 extending from its mounting flange 52. The flange 52 has a central opening 56 and a stepped recess 58 concentric with the opening 56. The recess 58 seats a seal, which can be a lip or mechanical seal ring 70 having a complementary configuration. Specifically, the seal ring 70 can be made from PTFE with a Wolastonite filler and can have an L-shaped (cross-sectional) profile as shown in detail in FIG. 3B. The seal ring 70 also can include a concentric O-ring 71 or the like, as shown in FIG. 3B. The opening 56 is dimensioned only slightly larger than the agitator's shaft 40. The seal ring 70 is adapted to engage the shaft 40 and seal the same while permitting the agitator 30 to rotate.

Referring to FIGS. 1A, 2, 3A, the cylindrical portion 54 is threaded on its inner side so that it can be attached to the motor 100. Specifically, the coupling 50 is attached to a shaft mount 110, which comprises an annular flange 112 and a downwardly extending cylindrical member 114. The cylindrical member 114 has an outer threading for threadingly mating with the threaded cylindrical portion 54 of the coupling 50. The flange 112 is mounted to the motor using bolts 200 or the like. The motor 100 can be mounted to a stand or fixture 150 via the flange 112, using bolts 200. The stand 150 allows the motor 100 and the vessel 10, 10A, 10B, 10C to be oriented vertically, as shown in FIGS. 1, 1A, 2, and 3.

The shaft mount 110 has a central through hole 115 dimensioned larger than the shaft 40. The distal (lower) end of the cylindrical member 114 has an annular projection 116 that bears against the seal ring 70 (see FIG. 3B) and holds the seal ring 70 in place. The coupling 50 has an annular end face 55 that abuts against a complementary face or shoulder 117 formed on the distal (lower) end of the cylindrical member 114, adjacent to the annular projection 116. The end face 55 provides a positive stop and maintains proper seal compression when the coupling 50 is mounted to the shaft mount 110. In this respect, referring to FIG. 3A, the mounting flange 52 can also include an O-ring 72 positioned in an annular groove 59 formed on the upper end face 55 to provide additional seal. As the temperature of the dispersion increases during milling, expanding air under pressure is designed to escape through the seal ring 70, while maintaining liquid seal. In this respect, the cylindrical member 114 has a vent opening 118 to vent any air seeping through the seal ring 70.

The rotor shaft 40 comprises a larger diameter portion 42 and a smaller diameter portion 44 having a threaded free end 45. A tapered section 46 extends between these portions 42, 44. The rotor 30 is attached to the motor 100 by inserting the smaller diameter portion 44 into a hollow motor shaft 120 and threading a nut 49 or a manual knob 49A (FIG. 3) onto the threaded end 45, which tightly pulls the tapered section 46 against the lower end or mouth of the hollow shaft 120, compressively attaching the agitator shaft 40 to the hollow motor shaft 120. The nut 49 or the knob 49A can be covered with a safety cap 47 (FIG. 3), which can be mounted to the top end of the motor 100 using a base 48. The cap 47 can be threadedly mounted to the base 48. The tapered section 46 also eases the insertion of the shaft 40 through the seal ring 70 and prevents tear or damage to the seal ring 70. At least around a section CP of the large diametered shaft portion 42 contacting the seal 70 is preferably coated with a wear resistant coating, such as a hard chrome coating to prevent wear.

Figure 4:
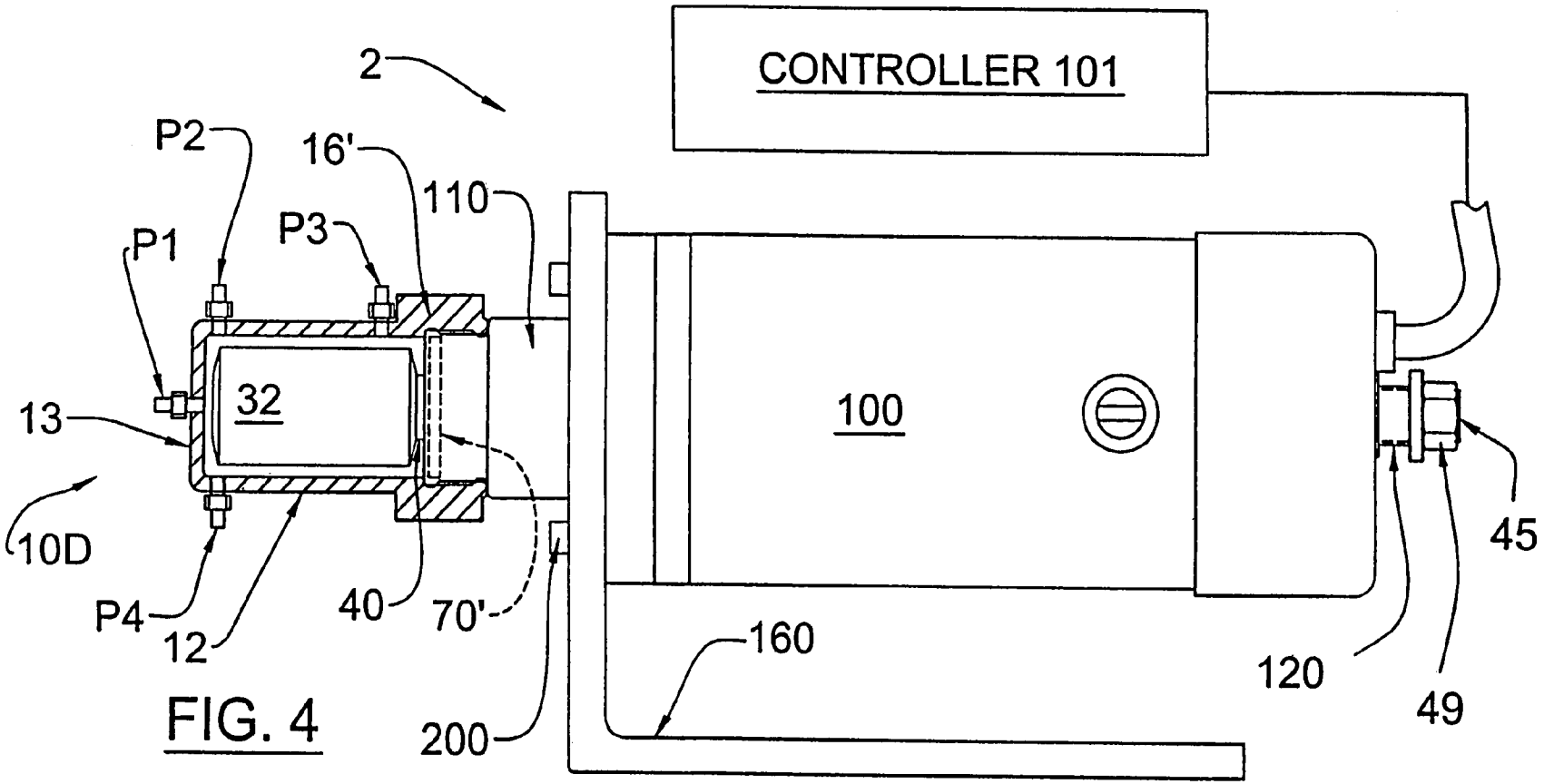
FIG. 4 illustrates a side view of a small scale or micro media mill according to another embodiment of the present invention.

Although the above-described mill 1 (FIGS. 1–3B) has been described and shown in a vertical configuration, the present invention also contemplates a horizontally oriented mill 2, as shown in FIG. 4. The horizontally oriented mill 2 is substantially similar to the vertically oriented mill 1 shown in FIGS. 1–3, except for the vessel and coupling configuration. In the horizontally oriented mill, a mounting bracket 160 is attached to the motor 100 via the shaft mount 110 so that the mill 2 is stably supported in the horizontal position, as shown in FIG. 4. In the horizontally oriented mill 2, its vessel 10D can be attached to the motor via a threaded coupling 16', and the shaft 40 can be sealed via a single or double mechanical seal, or a lip seal 70' (shown in phantom).

Referring to FIG. 4, the vessel 10D for the horizontally oriented mill 2 is substantially similar to the singled walled vessel 10C (FIGS. 5 and 6), except that the flange 16 (FIGS. 5 and 6) has a threaded coupling 16', substantially similar to the threaded coupling 50 shown in FIGS. 1–3A. The vessel 10D has an open cylindrical wall 12, with one closed by an end wall 13. The threaded coupling 16' is integrally or monolithically formed at the opposite open end. The vessel 10D, however, can be configured like the singled walled vessel 10C for use with the afore-described sanitary fitting.

The vessel 10D is illustrated with four fill/drain/cooling ports P1–P4 for illustrative purposes only. Only one port is needed in the horizontally oriented mill 2. The ports P2–P4 are radially extending through the cylindrical wall 12 of the vessel 10B, whereas the port P1 is axially extending from the end wall 13 of the vessel 10B. In one embodiment, the vessel 10D can have a single top fill port P2 or P3. In such an embodiment, it is especially desirable for the top port P2 or P3 to be located at or along the highest point of the milling chamber, i.e., at 12 O'clock position for a cylindrical vessel 10D, as this allows the chamber to be filled so that all of the air is displaced from the chamber. The absence of air in the milling chamber during operation prevents the formation of foam and enhances milling performance.

Alternatively, the horizontally oriented vessel 10D can contain two or more ports, such as two top radial ports P2 and P3, a single axial port P1 and a single top radial port P3, or a single top radial port P3 and a single bottom radial port P4. In such embodiments, the dispersion can be externally circulated through the vessel 10D, where one port acts as an outlet and the other an inlet. The dispersion can be cooled or replenished during the circulating process. Using two ports, one can recirculate (or add) the process fluid and/or attrition media via an external vessel and pump (not shown). If the attrition media has to remain in the vessel, the outlet port can be fitted with a suitable screen or filter to retain the media during operation.

Referring to FIGS. 5–13D, the rotor 32, 32A–32J (collectively "32") for both the vertically and horizontally oriented mills 1, 1A, 2 can have different geometric configurations. The agitator 30 is preferably made of stainless steel or teflon or stainless steel with a teflon coating. In this respect, the TRI-CLAMP can be made of 304 stainless steel. The components that are exposed to the dispersion also can be made of 316 stainless steel. In fact, all of the metal components, except the clamp and the motor can be made of 316 stainless steel. Alternatively, all metal components that become exposed to the dispersion can be made of any material that is resistant to crevice corrosion, pitting, and stress corrosion, such as an AL-6XN stainless steel alloy. An AL-6XN alloy meets ASME and ASTM specifications, and is approved by the USDA for use as a food contact surface.

Figure 13C:
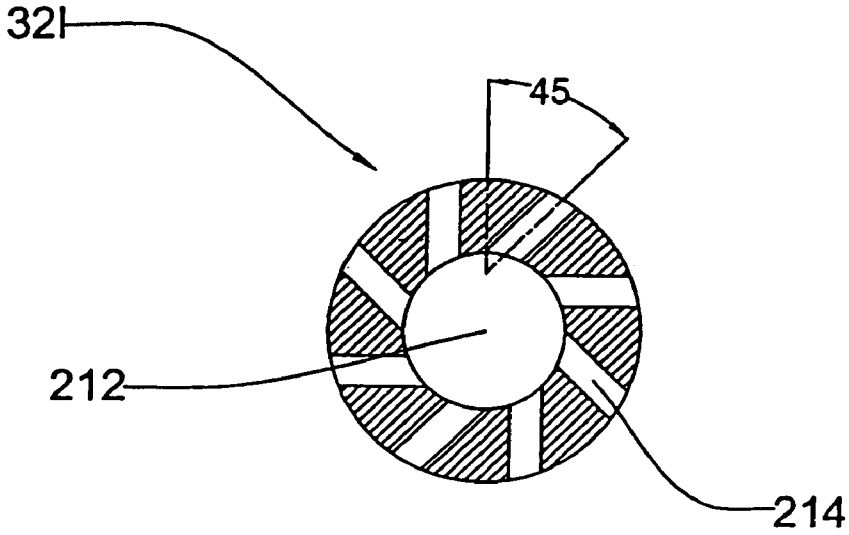
Figure 13B:
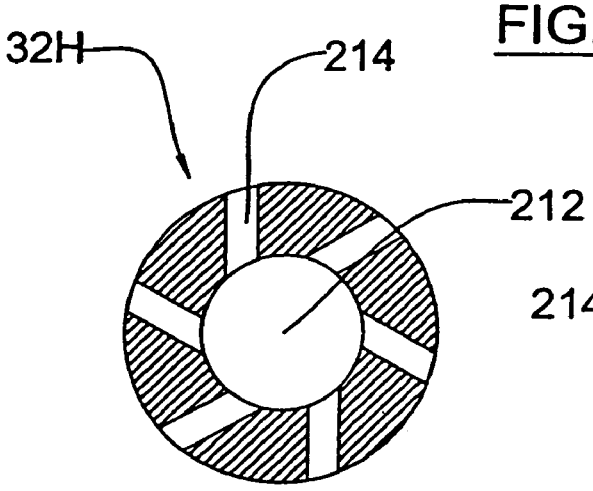
Figure 13D:
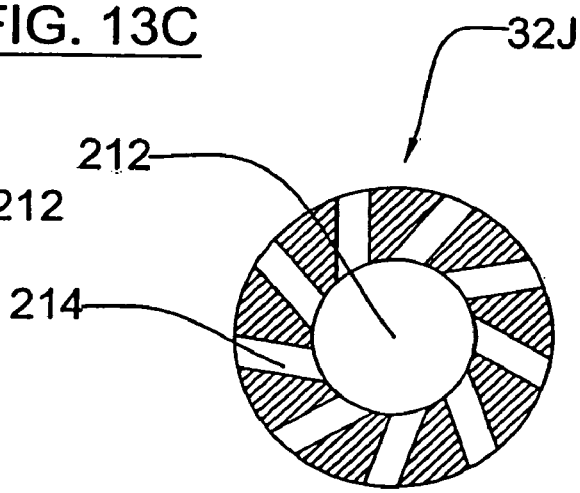

The rotor 32 also can comprise a variety of geometries, surface textures, and surface modifications, such as channels or protrusions to alter the fluid flow patterns. For example, the rotor 32 can be cylindrical (straight), as shown in FIG. 5, or cylindrical (tapered ends T1, T2) as shown in FIGS. 1–4 and 6. In other illustrated embodiments, the rotor 32 can be hexagonal (FIG. 7), ribbed (FIG. 8), square (FIG. 9), cylindrical with channels (FIGS. 10 and 11), cylindrical with passageways (FIG. 12), and cylindrical with a cavity and slots (FIGS. 13–13D). All of these embodiments can have tapered end surfaces T1, T2.

Specifically, the hexagonal rotor 32A (FIG. 7) has six planar sides 202. The ribbed rotor 32B (FIG. 8) has hexagonal sides 202 as shown in FIG. 7, but with six ribs 204 extending respectively from the middle of each of the six sides 202. The square rotor 32C (FIG. 9) has four planar sides 206. The cylindrical rotor 32D (FIG. 10) has four channels 208 that are perpendicular to each adjacent channels 208. The cylindrical rotor 32E (FIG. 11) is substantially identical to the cylindrical rotor 32D of FIG. 10, but has six channels 208 instead of four, symmetrically angled and spaced apart. The cylindrical rotor 32F (FIG. 12) has four angled passageways 210, extending from the tapered or conical end surfaces T1, T2. These angled passageways have four openings at the first tapered end surface T1 and four openings at the second tapered end surface T2. An imaginary circle intercepting the four openings at the first tapered end surface T1 has a greater diameter than an imaginary circle intercepting the four openings at the second tapered end surface T2.

The cylindrical rotors 32G, 32H, 32I, 32J (FIGS. 13–13D) each have a concentrical cylindrical cavity 212 opening to the second tapered surface T2. Depending on the material and the media mill size, these rotors can have at least three (not shown) equally spaced apart axially extending flow modifying channels 214. The rotors 32G–23J are respectively shown with four, six, eight, and nine channels 214. These slots 214 can also be angled as shown, or spiraled or helically configured (not shown) relative to the rotational axis. In the embodiment of FIG. 13A, four channels 214 can be angled 90° relative to the adjacent channels. In the embodiment of FIG. 13B, the six channels 214 can be angled 60°. In the embodiment of FIG. 13C, the eight channels 214 can be angled 45°. In the embodiment of FIG. 13D, the nine channels 214 can be angled 40° relative to the vertical. In alternative embodiments (not shown), the channels 214 can radially extend from the axis of the rotor 41.

The rotors 32G–32J of FIGS. 13A–13D can act as a pump. That is, these rotors can withdraw fluid into the cavity 212 and eject fluid outwardly through the channels 214, or conversely withdraw fluid into the cavity through the channels 214 and eject fluid outwardly through the cavity 212, depending on the direction of the rotation, to modify the dispersion flow pattern.

In other embodiments (not shown), rotors also can contain pegs, agitator discs, or a combination thereof.

Referring to the cylindrical rotor 32 shown in FIGS. 1–6, its outer peripheral cylindrical surface 36 and the inner cylindrical surface 12" of the inner cylindrical wall 12 of the vessel 10, 10A, 10B, 10C, 10D are dimensioned to provide a small gap X. The gap X is preferably no greater than 3 mm and no smaller than 0.3 mm. In general, this gap X should be approximately 6 times the diameter of the milling media, which is preferably made of cross linked polystyrene or other polymer as described in U.S. Pat. No. 5,718,388 issued to Czekai, et al. The largest attrition milling media preferably is nominally sized no greater than 500 microns (0.5 mm). Presently, the smallest attrition milling media contemplated is about 50 microns. Nonetheless, it is envisioned that a smaller attrition milling media can be suitable for milling certain non-soluble products, such as pharmaceutical products, which means that the gap X can be made smaller accordingly.

The vessel size can vary for milling small amounts of dispersion. Although the present invention is not limited to particular sizes, in the preferred embodiment, the inner diameter of the vessel is between ⅝ inch to 4 inches. By way of examples only, milling chamber of the vessel 10, 10A, 10B, 10C, and 10D and the cylindrical rotor 32 can have the dimensions specified in Tables 1 and 2.

TABLE 1

(STRAIGHT ROTORS)

| | CYLINDRICAL VESSEL Size | | |
|---|---|---|---|
| | #1 | #2 | #3 |
| | TRI-CLAMP Size VESSEL/COUPLING | | |
| | 2" TC | 2.5" TC | 3" TC |
| R-vessel (inch) (1/2 DC) | 0.685 | 0.935 | 1.185 |
| H-vessel (inch) (HC) | 1.125 | 1.125 | 1.125 |
| R-rotor (inch) (1/2 DR) | 0.567 | 0.817 | 1.063 |
| H-rotor (inch) (HR) | 0.890 | 0.890 | 0.890 |
| R-shaft (inch) (1/2 DS) | 0.313 | 0.313 | 0.313 |
| H-shaft (inch) (HS) | 0.118 | 0.118 | 0.118 |
| Volume Vessel ($in^3$) | 1.658 | 3.090 | 4.963 |
| Volume Rotor ($in^3$) | 0.899 | 1.866 | 3.156 |
| Volume Shaft ($in^3$) | 0.036 | 0.036 | 0.036 |

TABLE 1-continued (STRAIGHT ROTORS)

| | CYLINDRICAL VESSEL Size | | |
|---|---|---|---|
| | #1 | #2 | #3 |
| | TRI-CLAMP Size VESSEL/COUPLING | | |
| | 2" TC | 2.5" TC | 3" TC |
| Working Volume ($in^3$) | 0.723 | 1.187 | 1.770 |
| | 11.855 ml | 19.458 ml | 29.012 ml |
| Typical Dispersion Volume @ 50% media charge | 8.299 ml | 13.621 ml | 20.309 ml |
| Typical Dispersion Volume @ 90% media charge | 5.453 ml | 8.951 ml | 13.346 ml |

TABLE 2

(TAPERED ROTORS)

| | VESSEL Size | | |
|---|---|---|---|
| | #1 | #2 | #3 |
| | TRI-CLAMP Size VESSEL/COUPLING | | |
| | 2" TC | 2.5" TC | 3" TC |
| R-vessel (inch) (1/2 DC) | 0.685 | 0.935 | 1.185 |
| H-vessel (inch) (HC) | 1.190 | 1.190 | 1.190 |
| R-rotor (inch) (1/2 DR) | 0.567 | 0.817 | 1.063 |
| H-rotor (inch) (HR) | 1.018 | 1.018 | 1.018 |
| H-top taper (inch) (HTT) | 0.064 | 0.120 | 0.120 |
| H-bottom taper (inch) (HBT) | 0.064 | 0.075 | 0.075 |
| R-shaft (inch) (1/2 DS) | 0.313 | 0.313 | 0.313 |
| H-shaft (inch) (HS) | 0.086 | 0.086 | 0.086 |
| Volume Vessel ($in^3$) | 1.754 | 3.268 | 5.250 |
| Volume Rotor Body ($in^3$) | 0.899 | 1.726 | 2.919 |
| Volume Upper Cone ($in^3$) | 0.040 | 0.128 | 0.196 |
| Volume Lower Cone ($in^3$) | 0.040 | 0.080 | 0.122 |
| Volume Shaft ($in^3$) | 0.026 | 0.026 | 0.026 |
| Volume Complete Rotor ($in^3$) | 0.979 | 1.934 | 3.237 |
| Working Volume ($in^3$) | 0.749 | 1.308 | 1.986 |
| | 12.274 ml | 21.429 ml | 32.548 ml |
| Typical Dispersion Volume @ 50% media charge | 8.592 ml | 15.001 ml | 22.784 ml |
| Typical Dispersion Volume @ 90% media charge | 5.646 ml | 9.858 ml | 14.972 ml |

It was mentioned that the gap X between the rotor 32 and the inner surface 12" of the cylindrical wall 12 should be approximately 6 times the diameter of the attrition milling media. Nonetheless, the vessel and rotor combination can be used with 50, 200, 500 and mixtures of 50/200, 50/500, or 50/200/500 micron media These milling media also can be used with a gap X of 1 mm. The rotor speed is correlated to the rotor diameter to produce different tip speeds, which are related to the milling action. A too high tip speed can generate much heat and can evaporate the dispersion. A too low tip speed causes inefficient milling.

Tapering the ends of the rotor 32, as illustrated in FIGS. 1–4 and 6–13D can provide more uniform shear throughout the milling chamber. Although the shear rate between two concentric cylinders is relatively constant if the gap is narrow, a flat end (bottom or top) surface cylinder will produce less uniform shear stress. Referring to FIG. 6, by equating the shear rate for concentric cylinders and a cone shape surface T2 revolving about a flat bottomed vessel surface 13", one can calculate a tip angle $\beta = \arctan(1-DR/DC)$, where DR represents an outer cylindrical surface 36 of the rotor 32 and DC represents an inner cylindrical surface 12" of the vessel 10, 10A, 10B, 10C, 10D. Ideally, the cone should "touch" the bottom (or the top or the ends) to maintain a constant shear. This, however, is not practical. Instead, a cone is truncated, forming a gap d between the truncated bottom surface T2 and the opposing bottom vessel surface 13". The gap d is preferably defined by DT/2×tan β, where DT/2 is the distance between the center of rotation and the truncation edge. If DT/2 is sufficiently small in comparison with DR/2, a substantially uniform shear can be maintained. A uniform shear rate would allow the user to better estimate shearing effect in the milling of colloidal dispersions, although constant shear in the mill is not necessary to produce a colloidal dispersion. Another benefit to having a tapered bottom surface T2 is that it prevents the accumulation of suspended particles on the bottom near the center of rotation where the speed is at its minimal.

U.S. Pat. No. 5,145,684 issued to Liversidge et al., U.S. Pat. No. 5,518,187 issued to Bruno et al., and U.S. Pat. Nos. 5,718,388 and 5,862,999 issued to Czekai et al. disclose milling pharmaceutical products using polymeric milling media. These patents further disclose dispersion formulations for wet media milling. The disclosures of these patents are incorporated herein by reference.

In operation of the vertically oriented mill 1, 1A, an appropriate dispersion formulation containing the milling media and the product to be milled is prepared, which can be prepared according to the aforementioned patents. The dispersion is poured into the vessel 10, 10A, 10B, 10C to a level that would cause the dispersion to fill to the brim or the top face 61 (see FIGS. 5 and 6) of the gasket 60 (or even overflow) when the rotor 30 fully inserted to the vessel 10 to minimize trapping of air within the vessel. After filling appropriate amount of the dispersion into the vessel 10, 10A, 10C, the vessel is aligned with the coupling 50, which is premounted to the shaft mount 110, and raised until the vessel and coupling flanges 16, 52 line up. The aligned coupling flanges 16, 52 are held together using, for instance, a TRI-CLAMP C or the like, which couples the vessel 10, 10A, 10B, 10C to the coupling 50 and seals the dispersion. Similarly, the connectors 22, 22A are connected to a coolant inlet and outlet respectively using two TRI-CLAMPs or quick coupling 24A, one for each connector 22, 22A. Coolant, such as water, is circulated to cool the vessel 10, 10A, 10B, 10C. The motor controller 101 can be set to rotate the rotor for a predetermined period, depending on the dispersion formulation.

Because the coupling 50 seals the vessel 10, 10A, 10B, 10C, and because only a very small amount of air is trapped in the vessel, vortexing and contamination problems are minimized or avoided. Thus, the mill according to the present invention can prevent the dispersion formulation from foaming. Further, because the vessel is cooled, either by the cooling jacket or by circulating the dispersion, the rotor 32 can be spun faster. Thus, a higher energy can be transferred to the dispersion.

In the operation of the horizontally oriented mill 2, the vessel 10D is first mounted to the shaft mount 110 with either a threaded coupling 16' (as shown in FIG. 4) or a sanitary fitting (as shown in FIGS. 1–3) and with the rotor 32 positioned inside the vessel 10D as shown in FIG. 4. The dispersion formulation containing the milling media and the product to be milled is poured or injected through the top port P2 or P3 (only one being required) until all or substantially all of the air is displaced with the dispersion. The motor controller 101 then can be set to rotate the rotor 32 for a predetermined period, depending on the dispersion formulation. If the vessel 10D has multiple ports, such as P1, P3 or P2, P3, or P3, P4, the dispersion can be circulated via an external vessel and pump (not shown) during milling.

Because virtually all or substantially all of the air can be displaced in the horizontally oriented mill 2, vortexing and contamination problems are minimized or avoided. Thus, the mill according to the present invention can prevent the dispersion formulation from foaming. Further, because the dispersion can be circulated, where it can be cooled with external cooling system, the rotor can be spun faster and high energy can be transferred to the dispersion. Moreover, the dispersion can be refreshed or made in batches or inspected without having to disassemble the vessel 10D from the shaft mount 110.

Exemplary Pharmaceutical Products

The pharmaceutical products herein include those products described in the aforementioned patents incorporated herein by reference and any human or animal ingestable products and cosmetic products.

As disclosed in U.S. Pat. No. 5,145,684 for "Surface Modified Drug Nanoparticles" to Liversidge et al., the drug substance must be poorly soluble and dispersible in at least one liquid medium. By "poorly soluble" it is meant that the drug substance has a solubility in the liquid dispersion medium of less than about 10 mg/ml, and preferably of less than about 1 mg/ml.

A preferred liquid dispersion medium is water. However, other liquid media in which a drug substance is poorly soluble and dispersible can be employed in the milling process, such as, for example, aqueous salt solutions, safflower oil, and solvents such as ethanol, t-butanol, hexane, and glycol.

Suitable drug substances can be selected from a variety of known classes of drugs including, for example, analgesics, anti-inflammatory agents, anthelmintics, anti-arrhythmic agents, antibiotics (including penicillins), anticoagulants, antidepressants, antidiabetic agents, antiepileptics, antihistamines, antihypertensive agents, antimuscarinic agents, antimycobacterial agents, antineoplastic agents, immunosuppressants, antithyroid agents, antiviral agents, anxiolytic sedatives (hypnotics and neuroleptics), astringents, beta-adrenoceptor blocking agents, blood products and substitutes, cardiac inotropic agents, contrast media, corticosteroids, cough suppressants (expectorants and mucolytics), diagnostic agents, diagnostic imaging agents, diuretics, dopaminergics (antiparkinsonian agents), haemostatics, immunological agents, lipid regulating agents, muscle relaxants, parasympathomimetics, parathyroid calcitonin and biphosphonates, prostaglandins, radio-pharmaceuticals, sex hormones (including steroids), anti-allergic agents, stimulants and anoretics, sympathomimetics, thyroid agents, vasodilators, xanthines, and antiviral agents. Preferred drug substances include those intended for oral administration and intravenous administration.

A description of these classes of drugs and a listing of species within each class can be found in Martindale, *The Extra Pharmacopoeia*, Twenty-ninth Edition (The Pharmaceutical Press, London, 1989), the disclosure of which is hereby incorporated by reference in its entirety. The drug substances are commercially available and/or can be prepared by techniques known in the art.

As taught in U.S. Pat. No. 5,518,187, the invention is also applicable for the grinding of particles for cosmetic and photographic compositions.

In addition, as taught in U.S. Pat. No. 5,718,388 for "Continuous Method of Grinding Pharmaceutical Substances" to Czekai et al.; U.S. Pat. No. 5,518,187 for "Method of Grinding Pharmaceutical Substances" to Bruno et al.; and U.S. Pat. No. 5,862,999 for "Method of Grinding Pharmaceutical Substances" to Czekai et al., other suitable drug substances include NSAIDs described in U.S. patent application Ser. No. 897,193, filed on Jun. 10, 1992, and the anticancer agents described in U.S. patent application Ser. No. 908,125, filed on Jul. 1, 1992. U.S. patent application Ser. No. 897,193 was abandoned and refiled on Mar. 13, 1995, as U.S. patent application Ser. No. 402,662, now U.S. Pat. No. 5,552,160 for "Surface Modified NSAID Nanoparticles." U.S. patent application Ser. No. 908,125 issued as U.S. Pat. No. 5,399,363 for "Surface Modified Anticancer Nanoparticles."

U.S. Pat. No. 5,552,160 states that useful NSAIDS can be selected from suitable acidic and nonacidic compounds. Suitable acidic compounds include carboxylic acids and enolic acids. Suitable nonacidic compounds include, for example, nabumetone, tiaramide, proquazone, bufexamac, flumizole, epirazole, tinoridine, timegadine, and dapsone. Suitable carboxylic acid NSAIDs include, for example: (1) salicylic acids and esters thereof, such as aspirin; (2) phenylacetic acids such as diclofenac, alclofenac, and fenclofenac; (3) carbo- and heterocyclic acetic acids such as etodolac, indomethacin, sulindac, tolmetin, fentiazac, and tilomisole; (4) propionic acids such as carprofen, fenbufen, flurbiprofen, ketoprofen, oxaprozin, suprofen, tiaprofenic acid, ibuprofen, naproxen, fenoprofen, indoprofen, and pirprofen; and (5) fenamic acids such as flufenamic, mefenamic, meclofenamic, and niflumic. Suitable enolic acid NSAIDs include, for example: (1) pyrazolones such as oxyphenbutazone, phenylbutazone, apazone, and feprazone; and (2) oxicams such as piroxicam, sudoxicam, isoxicam, and tenoxicam.

U.S. Pat. No. 5,399,363 states that useful anticancer agents are preferably selected from alkylating agents, antimetabolites, natural products, hormones and antagonists, and miscellaneous agents, such as radiosensitizers.

Examples of alkylating agents include: (1) alkylating agents having the bis-(2-chloroethyl)-amine group such as, for example, chlormethine, chlorambucile, melphalan, uramustine, mannomustine, extramustinephoshate, mechlorethaminoxide, cyclophosphamide, ifosfamide, and trifosfamide; (2) alkylating agents having a substituted aziridine group such as, for example, tretamine, thiotepa, triaziquone, and mitomycine; (3) alkylating agents of the alkyl sulfonate type, such as, for example, busulfan, piposulfan, and piposulfam; (4) alkylating N-alkyl-N-nitrosourea derivatives, such as, for example, carmustine, lomustine, semustine, or streptozotocine; and (5) alkylating agents of the mitobronitole, dacarbazine, and procarbazine type.

Examples of antimetabolites include: (1) folic acid analogs, such as, for example, methotrexate; (2) pyrimidine analogs such as, for example, fluorouracil, floxuridine, tegafur, cytarabine, idoxuridine, and flucytosine; and (3) purine derivatives such as, for example, mercaptopurine, thioguanine, azathioprine, tiamiprine, vidarabine, pentostatin, and puromycine.

Examples of natural products include: (1) vinca alkaloids, such as, for example, vinblastine and vincristine; (2) epipodophylotoxins, such as, for example, etoposide and teniposide; (3) antibiotics, such as, for example, adriamycine, daunomycine, doctinomycin, daunorubicin, doxonibicin, mithramycin, bleomycin, and mitomycin; (4) enzymes, such as, for example, L-asparaginase; (5) biological response modifiers, such as, for example, alpha-interferon; (6) camptothecin; (7) taxol; and (8) retinoids, such as retinoic acid.

Examples of hormones and antagonists include: (1) adrenocorticosteroids, such as, for example, prednisone; (2) progestins, such as, for example, hydroxyprogesterone caproate, medroxyprogesterone acetate, and megestrol acetate; (3) estrogens, such as, for example, diethylstilbestrol and ethinyl estradiol; (4) antiestrogens, such as, for example, tamoxifen; (5) androgens, such as, for example, testosterone propionate and fluoxymesterone; (6) antiandrogens, such as, for example, flutamide; and (7) gonadotropin-releasing hormone analogs, such as, for example leuprolide.

Examples of miscellaneous agents include: (1) radiosensitizers, such as, for example, 1,2,4-benzotriazin-3-amine 1,4-dioxide (SR 4889) and 1,2,4-benzotriazine-7-amine 1,4-dioxide (WIN 59075); (2) platinum coordination complexes such as cisplatin and carboplatin; (3) anthracenediones, such as, for example, mitoxantrone; (4) substituted ureas, such as, for example, hydroxyurea; (5) and adrenocortical suppressants, such as, for example, mitotane and aminoglutethimide.

In addition, the anticancer agent can be an immunosuppressive drug, such as, for example, cyclosporine, azathioprine, sulfasalazine, methoxsalen, and thalidomide.

Surface Modifiers

Also as disclosed in U.S. Pat. No. 5,145,684, the drug particles comprise a discrete phase of a drug substance having a surface modifier adsorbed on the surface thereof. Useful surface modifiers are believed to include those which physically adhere to the surface of the drug substance but do not chemically bond to the drug.

Suitable surface modifiers can preferably be selected from known organic and inorganic pharmaceutical excipients. Such excipients include various polymers, low molecular weight oligomers, natural products and surfactants. Preferred surface modifiers include nonionic and anionic surfactants.

Representative examples of excipients include gelatin, casein, lecithin (phosphatides), gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, e.g., macrogol ethers such as cetomacrogol 1000, polyoxyethylene castor oil derivatives, polyoxyethylene sorbitan fatty acid esters, e.g., the commercially available Tweens, polyethylene glycols, polyoxyethylene stearates, colloidol silicon dioxide, phosphates, sodium dodecylsulfate, carboxymethylcellulose calcium, carboxymethylcellulose sodium, methylcellulose, hydroxyethylcellulose, hydroxypropylcellulose, hydroxypropylmethycellulose phthalate, noncrystalline cellulose, magnesium aluminum silicate, triethanolamine, polyvinyl alcohol, and polyvinylpyrrolidone (PVP).

Most of these excipients are described in detail in the *Handbook of Pharmaceutical Excipients*, published jointly by the American Pharmaceutical Association and The Pharmaceutical Society of Great Britain, the Pharmaceutical Press (1986), the disclosure of which is hereby incorporated by reference in its entirety. The surface modifiers are commercially available and/or can be prepared by techniques known in the art.

Particularly preferred surface modifiers include polyvinylpyrrolidone, Pluronic® F68 and F108, which are block copolymers of ethylene oxide and propylene oxide, Tetronic® 908, which is a tetrafunctional block copolymer derived from sequential addition of ethylene oxide and propylene oxide to ethylenediamine, dextran, lecithin, Aerosol OT® (American Cyanamid), which is a dioctyl ester of sodium sulfosuccinic acid, Duponol P® (DuPont), which is a sodium lauryl sulfate, Triton X-200® (Robin and Haas), which is an alkyl aryl polyether sulfonate, Tween® 80 (ICI Specialty Chemicals), which is a polyoxyethylene sorbitan fatty acid ester, and Carbowax® 3350 and 934 (Union Carbide), which are polyethylene glycols. Surface modifiers which have found to be particularly useful include polyvinylpyrrolidone, Pluronic® F-68, and lecithin.

The surface modifier does not chemically react with the drug substance or itself. Furthermore, the individually adsorbed molecules of the surface modifier are essentially free of intermolecular crosslinkages.

The drug particles can be reduced in size in the presence of a surface modifier. Alternatively, the particles can be contacted with a surface modifier after attrition.

The relative amount of drug substance and surface modifier can vary widely and the optimal amount of the surface modifier can depend, for example, upon the particular drug substance and surface modifier selected, the critical micelle concentration of the surface modifier if it forms micelles, etc. The surface modifier preferably is present in an amount of about 0.1–10 mg per square meter surface area of the drug substance. The surface modifier can be present in an amount of 0.1–90%, preferably 20–60% by weight based on the total weight of the dry particle.

Particle Size

Also disclosed in U.S. Pat. No. 5,145,684 is the particle size of the milled pharmaceutical substances. As used herein, particle size refers to a number average particle size as measured by conventional particle size measuring techniques well known to those skilled in the art, such as sedimentation field flow fractionation, photon correlation spectroscopy, or disk centrifugation. By "an effective average particle size of less than about 400 nm" it is meant that at least 90% of the particles have a weight average particle size of less than about 400 nm when measured by the above-noted techniques. In other embodiments of the invention, the effective average particle size is less than about 250 nm. In some embodiments of the invention, an effective average particle size of less than about 100 nm has been achieved.

As disclosed in U.S. Pat. Nos. 5,862,999, 5,518,187, and 5,718,388, the particle size of the milled compound can be submicron or nanoparticulate. In other embodiments described by these patents, the average particle size of the milled compound can be less than about 500 nm, less than about 400 nm, less than about 300 nm, or less than about 100 nm.

With reference to the effective average particle size, it is preferred that at least 95% and, more preferably, at least 99% of the particles have a particle size less than the effective average, e.g., 400 nm. In particularly preferred embodiments, essentially all of the particles have a size less than 400 nm. In some embodiments, essentially all of the particles have a size less than 250 nm.

Grinding Media

As disclosed in U.S. Pat. Nos. 5,145,684 and 5,862,999, the grinding media for the particle size reduction step can be selected from rigid media, preferably spherical or particulate in form, having an average size less than about 3 mm and, more preferably, less than about 1 mm. However, grinding media in the form of other non-spherical shapes are expected to be useful in the practice of this invention. Such media desirably can provide the particles of the invention with shorter processing times and impart less wear to the milling equipment.

As disclosed in U.S. Pat. No. 5,862,999, the grinding media can range in size up to about 100 microns. For fine grinding, the grinding particles preferably have a mean size of less than about 75 microns, more preferably, less than about 50 microns, and, most preferably, less than about 25 microns, in size. Excellent particle size reduction has been achieved with media having a particle size of about 5 microns.

As disclosed in U.S. Pat. No. 5,518,187, the grinding media can range in size from about 0.1 to 3 mm. For fine grinding, the grinding particles preferably are from 0.2 to 2 mm, more preferably, 0.25 to 1 mm in size.

As disclosed in U.S. Pat. No. 5,718,388, the grinding media can range in size up to about 1000 microns. Other useful sizes of grinding media include media having a particle size of less than about 300 microns, less than about 75 microns, or less than about 50 microns.

As disclosed in U.S. Pat. No. 5,718,288, grinding media having mixed media sizes can be utilized. For example, larger media may be employed in a conventional manner where such media is restricted to the milling chamber. Smaller grinding media may be continuously recirculated through the system and permitted to pass through the agitated bed of larger grinding media. In this embodiment, the smaller media is preferably between about 1 and 300 microns in mean particle size and the larger grinding media is between about 300 and 1000 microns in mean particle size.

As disclosed in U.S. Pat. Nos. 5,145,684, 5,862,999, and 5,718,388, the selection of material for the grinding media is not believed to be critical. It has been found that zirconium oxide, such as 95% ZrO stabilized with magnesia, zirconium silicate, glass, stainless steel, titania, alumina, and 95% ZrO stabilized with yttrium grinding media provide particles having levels of contamination which are believed to be acceptable for the preparation of pharmaceutical compositions. Preferred media have a density greater than about 3 $g/cm^3$.

As disclosed in U.S. Pat. Nos. 5,862,999, 5,518,187, and 5,718,388, the grinding media can comprise particles, preferably substantially spherical in shape, e.g., beads, of a polymeric resin.

In general, polymeric resins suitable for use herein are chemically and physically inert, substantially free of metals, solvent and monomers, and of sufficient hardness and friability to enable them to avoid being chipped or crushed during grinding. Suitable polymeric resins include crosslinked polystyrenes, such as polystyrene crosslinked with divinylbenzene, styrene copolymers, polyacrylates such as polymethyl methylcrylate, polycarbonates, polyacetals, such as Delrin™., vinyl chloride polymers and copolymers, polyurethanes, polyamides, poly(tetrafluoroethylenes), e.g., Teflon™, and other fluoropolymers, high density polyethylenes, polypropylenes, cellulose ethers and esters such as cellulose acetate, polyhydroxymethacrylate, polyhydroxyethyl acrylate, silicone containing polymers such as polysiloxanes and the like.

The polymer can be biodegradable. Exemplary biodegradable polymers include poly(lactides), poly(glycolide) copolymers of lactides and glycolide, polyanhydrides, poly (hydroxyethyl methacrylate), poly(imino carbonates), poly (N-acylhydroxyproline)esters, poly(N-palmitoyl hydroxyproline) esters, ethylene-vinyl acetate copolymers, poly (orthoesters), poly(caprolactones), and poly(phosphazenes). In the case of biodegradable polymers, contamination from the media itself advantageously can metabolize in vivo into biologically acceptable products which can be eliminated from the body.

The polymeric resin can have a density from 0.8 to 3.0 g/cm$^3$. Higher density resins are preferred inasmuch as it is believed that these provide more efficient particle size reduction.

As disclosed in U.S. Pat. No. 5,518,187, the grinding media can comprise particles comprising a core having a coating of the polymeric resin adhered thereon. The core material preferably can be selected from materials known to be useful as grinding media when fabricated as spheres or particles. Suitable core materials include zirconium oxides (such as 95% zirconium oxide stabilized with magnesia or yttrium), zirconium silicate, glass, stainless steel, titania, alumina, ferrite and the like. Preferred core materials have a density greater than about 2.5 g/cm$^3$. The selection of high density core materials is believed to facilitate efficient particle size reduction.

Useful thicknesses of the polymer coating on the core are believed to range from about 1 to about 500 microns, although other thicknesses outside this range may be useful in some applications. The thickness of the polymer coating preferably is less than the diameter of the core.

The cores can be coated with the polymeric resin by techniques known in the art. Suitable techniques include spray coating, fluidized bed coating, and melt coating. Adhesion promoting or tie layers can optionally be provided to improve the adhesion between the core material and the resin coating. The adhesion of the polymer coating to the core material can be enhanced by treating the core material to adhesion promoting procedures, such as roughening of the core surface, corona discharge treatment, and the like.

Milling Process

As disclosed in U.S. Pat. No. 5,718,388, the milling process can be continuous. In such a process, the active agent to be milled and rigid grinding media are continuously introduced into a milling chamber, the active agent is contacted with the grinding media while in the chamber to reduce the particle size of the active agent, the agent and the grinding media are continuously removed from the milling chamber, and thereafter the active agent is separated from the grinding media.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

We claim:

1. A method of milling a pharmaceutical product comprising:

(a) providing a dispersion containing the product to be milled and attrition milling media, wherein the attrition milling media has a mean particle size of less than about 1000 microns;

(b) inserting the dispersion into a vessel;

(c) providing an agitator and a coupling that closes the vessel, the coupling having an opening through which a portion of the agitator extends, the agitator comprising a rotor and a shaft extending therefrom, wherein the rotor is dimensioned so that an outer periphery is no greater than 3 mm away from an inner surface of the wall of the vessel;

(d) inserting the agitator into the vessel and sealingly closing the coupling, wherein the vessel is filled so that the dispersion eliminates substantially all of the air in the vessel when the agitator is fully inserted into the vessel; and (e) rotating the agitator for a predetermined period, wherein the resulting milled pharmaceutical product has a submicron mean particle size.

2. The method of claim 1, wherein the pharmaceutical product is milled in the presence of at least one surface modifier.

3. The method of claim 2, wherein the at least one surface modifier is selected from the group consisting of gelatin, casein, lecithin, gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, polyoxyethylene castor oil derivatives, polyoxyethylene sorbitan fatty acid esters, polyethylene glycols, polyoxyethylene stearates, colloidol silicon dioxide, phosphates, sodium dodecylsulfate, carboxymethylcellulose calcium, carboxymethylcellulose sodium, methylcellulose, hydroxyethylcellulose, hydroxypropylcellulose, hydroxypropylmethycellulose phthalate, noncrystalline cellulose, magnesium aluminum silicate, triethanolamine, polyvinyl alcohol, polyvinylpyrrolidone, block copolymers of ethylene oxide and propylene oxide, a tetrafunctional block copolymer derived from sequential addition of ethylene oxide and propylene oxide to ethylenediamine, dextran, a dioctyl ester of sodium sulfosuccinic acid, a sodium lauryl sulfate, and an alkyl aryl polyether sulfonate.

4. The method of claim 2, wherein the ratio of the distance between the outer periphery of the rotor and the inner surface of the wall to the attrition milling media nominal size is about 6 to about 1.

5. The method of claim 2, wherein the attrition media has a mean particle size selected from the group consisting of: (a) less than about 500 microns; (b) less than about 300 microns; (c) less than about 250 microns; (d) less than about 200 microns; (e) less than about 100 microns; (f) less than about 75 microns; (g) less than about 50 microns, (h) less than about 25 microns; (i) less than about 5 microns; and (j) a mixture thereof.

6. The method of claim 2, wherein the attrition media is selected from the group consisting of polymeric, zirconium oxide, zirconium silicate, glass, stainless steel, titania, alumina, and 95% ZrO stabilized with yttrium.

7. The method of claim 2, wherein the working volume of the vessel is about 12 mL to about 33 mL.

8. The method of claim 2, wherein the volume of the dispersion is about 5 ml to about 23 mL.

9. The method of claim 2, wherein the volume of the dispersion is less than about 10 mL.

10. The method of claim 2, wherein the method further comprises maintaining substantially uniform shear between the rotor and the and the cylindrical vessel.

11. The method of claim 2, wherein at the completion of the rotation period, the pharmaceutical product has an average particle size selected from the group consisting of less than about 500 nm, less than about 400 nm, less than about 300 nm, and less than about 100 nm.

12. The method of claim 11, wherein at least 90% of the milled pharmaceutical product particles have a size less than that selected from the group consisting of less than about 500 nm, less than about 400 nm, less than about 300 nm, and less than about 100 nm.

13. The method of claim 11, wherein at least 95% of the milled pharmaceutical product particles have a size less than that selected from the group consisting of less than about 500 nm, less than about 400 nm, less than about 300 nm, and less than about 100 nm.

14. The method of claim 11, wherein at least 99% of the milled pharmaceutical product particles have a size less than that selected from the group consisting of less than about 500 nm, less than about 400 nm, less than about 300 nm, and less than about 100 nm.

15. The method of claim 2, wherein the dispersion is recirculated through the vessel during rotation of the agitator.

16. The method of claim 2, wherein the pharmaceutical product is a heat sensitive product.

17. The method of claim 2, wherein the pharmaceutical product is selected from the group consisting of analgesics, anti-inflammatory agents, anthelmintics, anti-arrhythmic agents, antibiotics, anticoagulants, antidepressants, antidiabetic agents, antiepileptics, antihistamines, antihypertensive agents, antimuscarinic agents, antimycobacterial agents, antineoplastic agents, immunosuppressants, antithyroid agents, antiviral agents, anxiolytic sedatives, astringents, beta-adrenoceptor blocking agents, blood products, blood substitutes, cardiac inotropic agents, contrast media, corticosteroids, cough suppressants, diagnostic agents, diagnostic imaging agents, diuretics, dopaminergics, haemostatics, immunological agents, lipid regulating agents, muscle relaxants, parasympathomimetics, parathyroid calcitonin, parathyroid biphosphonates, prostaglandins, radio-pharmaceuticals, sex hormones, anti-allergic agents, stimulants, anoretics, sympathomimetics, thyroid agents, vasodilators, and xanthines.

18. The method of claim 2, wherein the product is an NSAID.

19. The method of claim 18, wherein the NSAID is selected from the group consisting of nabumetone, tiaramide, proquazone, bufexamac, flumizole, epirazole, tinoridine, timegadine, dapsone, aspirin, diclofenac, alclofenac, fenclofenac, etodolac, indomethacin, sulindac, tolmetin, fentiazac, tilomisole, carprofen, fenbufen, flurbiprofen, ketoprofen, oxaprozin, suprofen, tiaprofenic acid, ibuprofen, naproxen, fenoprofen, indoprofen, pirprofen, flufenamic, mefenamic, meclofenamic, niflumic, oxyphenbutazone, phenylbutazone, apazone, feprazone, piroxicam, sudoxicam, isoxicam, and tenoxicam.

20. The method of claim 2, wherein the product is an anticancer agent.

21. The method of claim 20, wherein the anticancer agent is selected from the group consisting of alkylating agents, antimetabolites, natural products, hormones, and antagonists.

22. The method of claim 21, wherein the anticancer agent is selected from the group consisting of: (1) alkylating agents having the bis-(2-chloroethyl)-amine group; (2) alkylating agents having a substituted aziridine group; (3) alkylating agents of the alkyl sulfonate type; (4) alkylating N-alkyl-N-nitrosourea derivatives; (5) alkylating agents of the mitobronitole type; (6) alkylating agents of the dacarbazine type; and (7) alkylating agents of the procarbazine type.

23. The method of claim 22, wherein the anticancer agent is selected from the group consisting of chlormethine, chlorambucile, melphalan, uramustine, mannomustine, extramustinephoshate, mechlore-thaminoxide, cyclophosphamide, ifosfamide, trifosfamide, tretamine, thiotepa, triaziquone, mitomycine, busulfan, piposulfan, piposulfam, carmustine, lomustine, semustine, streptozotocine.

24. The method of claim 21, wherein the anticancer agent is selected from the group consisting of: (1) folic acid analogs; (2) pyrimidine analogs; and (3) purine derivatives.

25. The method of claim 24, wherein the anticancer agent is selected from the group consisting of methotrexate, fluorouracil, floxuridine, tegafur, cytarabine, idoxuridine, flucytosine, mercaptopurine, thioguanine, azathioprine, tiamiprine, vidarabine, pentostatin, and puromycine.

26. The method of claim 21, wherein the anticancer agent is selected from the group consisting of vinca alkaloids, epipodophylotoxins, antibiotics, enzymes, biological response modifiers, camptothecin, taxol, and retinoids.

27. The method of claim 26, wherein the anticancer agent is selected from the group consisting of vinblastine, vincristine, etoposide, teniposide, adriamycine, daunomycine, doctinomycin, daunorubicin, doxorubicin, mithramycin, bleomycin, mitomycin, L-asparaginase, alpha-interferon and retinoic acid.

28. The method of claim 21, wherein the anticancer agent is selected from the group consisting of adrenocorticosteroids, progestins, estrogens, antiestrogens, androgens, antiandrogens, and gonadotropin-releasing hormone analogs.

29. The method of claim 28, wherein the anticancer agent is selected from the group consisting of prednisone, hydroxyprogesterone caproate, medroxyprogesterone acetate, megestrol acetate, diethylstilbestrol, ethinyl estradiol, tamoxifen, testosterone propionate, fluoxymesterone, flutamide, and leuprolide.

30. The method of claim 21, wherein the anticancer agent is selected from the group consisting of radiosensitizers, platinum coordination complexes, anthracenediones, substituted ureas, adrenocortical suppressants, and an immunosuppressive drug.

31. A method of milling a human or animal ingestable product comprising:

(a) providing a dispersion containing the product to be milled and attrition milling media, wherein the attrition milling media has a mean particle size of less than about 1000 microns;

(b) inserting the dispersion into a vessel;

(c) providing an agitator and a coupling that closes the vessel, the coupling having an opening through which a portion of the agitator extends, the agitator comprising a rotor and a shaft extending therefrom, wherein the rotor is dimensioned so that an outer periphery is no greater than 3 mm away from an inner surface of the vessel wall;

(d) inserting the agitator into the vessel and sealingly closing the coupling, wherein the vessel is filled so that the dispersion eliminates substantially all of the air in the vessel when the agitator is fully inserted into the vessel; and (e) rotating the agitator for a predetermined period, wherein the resulting human or animal ingestable product has a submicron mean particle size.

32. The method of claim 31, wherein the human or animal ingestable product is milled in the presence of at least one surface modifier.

33. The method of claim 32, wherein the at least one surface modifier is selected from the group consisting of gelatin, casein, lecithin, gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, polyoxyethylene castor oil derivatives, polyoxyethylene sorbitan fatty acid esters, polyethylene glycols, polyoxyethylene stearates, colloidol silicon dioxide, phosphates, sodium dodecylsulfate, carboxymethylcellulose calcium, carboxymethylcellulose sodium, methylcellulose, hydroxyethylcellulose, hydroxypropylcellulose, hydroxypropylmethycellulose phthalate, noncrystalline cellulose, magnesium aluminum silicate, triethanolamine, polyvinyl alcohol, polyvinylpyrrolidone, block copolymers of ethylene oxide and propylene oxide, a tetrafunctional block copolymer derived from sequential addition of ethylene oxide and propylene oxide to ethylenediamine, dextran, a dioctyl ester of sodium sulfosuccinic acid, a sodium lauryl sulfate, and an alkyl aryl polyether sulfonate.

34. The method of claim 32, wherein the ratio of the distance between the outer periphery of the rotor and the inner surface of the wall to the attrition milling media nominal size is about 6 to about 1.

35. The method of claim 32, wherein the attrition media has a mean particle size selected from the group consisting of: (a) less than about 500 microns; (b) less than about 300 microns; (c) less than about 250 microns; (d) less than about 200 microns; (e) less than about 100 microns; (f) less than about 75 microns; (g) less than about 50 microns, (h) less than about 25 microns; (i) less than about 5 microns; and (j) a mixture thereof.

36. The method of claim 32, wherein the attrition media is selected from the group consisting of polymeric, zirconium oxide, zirconium silicate, glass, stainless steel, titania, alumina, and 95% ZrO stabilized with yttrium.

37. The method of claim 32, wherein the working volume of the vessel is about 12 mL to about 33 mL.

38. The method of claim 32, wherein the volume of the dispersion is about 5 ml to about 23 mL.

39. The method of claim 32, wherein the volume of the dispersion is less than about 10 mL.

40. The method of claim 32, wherein the method further comprises maintaining substantially uniform shear between the rotor and the and the vessel.

41. The method of claim 32, wherein at the completion of the rotation period, the human or animal ingestable product has an average particle size selected from the group consisting of less than about 500 nm, less than about 400 nm, less than about 300 nm, and less than about 100 nm.

42. The method of claim 41, wherein at least 90% of the milled human or animal ingestable product particles have a size less than that selected from the group consisting of less than about 500 nm, less than about 400 nm, less than about 300 nm, and less than about 100 nm.

43. The method of claim 41, wherein at least 95% of the milled human or animal ingestable product particles have a size less than that selected from the group consisting of less than about 500 nm, less than about 400 nm, less than about 300 nm, and less than about 100 nm.

44. The method of claim 41, wherein at least 99% of the milled human or animal ingestable product particles have a size less than that selected from the group consisting of less than about 500 nm, less than about 400 nm, less than about 300 nm, and less than about 100 nm.

45. The method of claim 32, wherein the dispersion is recirculated through the vessel during rotation of the agitator.

46. A method of milling a cosmetic product comprising:

(a) providing a dispersion containing the product to be milled and attrition milling media, wherein the attrition milling media has a mean particle size of less than about 1000 microns (b) inserting the dispersion into a vessel;

(c) providing an agitator and a coupling that closes the vessel, the coupling having an opening through which a portion of the agitator extends, the agitator comprising a rotor and a shaft extending therefrom, wherein the rotor is dimensioned so that an outer periphery is no greater than 3 mm away from an inner surface of the vessel wall;

(d) inserting the agitator into the vessel and sealingly closing the coupling, wherein the vessel is filled so that the dispersion eliminates substantially all of the air in the vessel when the agitator is fully inserted into the vessel; and (e) rotating the agitator for a predetermined period, wherein the resulting cosmetic product has a submicron mean particle size.

47. The method of claim 46, wherein the cosmetic product is milled in the presence of at least one surface modifier.

48. The method of claim 47, wherein the at least one surface modifier is selected from the group consisting of gelatin, casein, lecithin, gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, polyoxyethylene castor oil derivatives, polyoxyethylene sorbitan fatty acid esters, polyethylene glycols, polyoxyethylene stearates, colloidol silicon dioxide, phosphates, sodium dodecylsulfate, carboxymethylcellulose calcium, carboxymethylcellulose sodium, methylcellulose, hydroxyethylcellulose, hydroxypropylcellulose, hydroxypropylmethycellulose phthalate, noncrystalline cellulose, magnesium aluminum silicate, triethanolamine, polyvinyl alcohol, polyvinylpyrrolidone, block copolymers of ethylene oxide and propylene oxide, a tetrafunctional block copolymer derived from sequential addition of ethylene oxide and propylene oxide to ethylenediamine, dextran, a dioctyl ester of sodium sulfosuccinic acid, a sodium lauryl sulfate, and an alkyl aryl polyether sulfonate.

49. The method of claim 47, wherein the ratio of the distance between the outer periphery of the rotor and the inner surface of the wall to the attrition milling media nominal size is about 6 to about 1.

50. The method of claim 47, wherein the attrition media has a mean particle size selected from the group consisting of: (a) less than about 500 microns; (b) less than about 300 microns; (c) less than about 250 microns; (d) less than about 200 microns; (e) less than about 100 microns; (f) less than about 75 microns; (g) less than about 50 microns, (h) less than about 25 microns; (i) less than about 5 microns; and (j) a mixture thereof.

51. The method of claim 47, wherein the attrition media is selected from the group consisting of polymeric, zirconium oxide, zirconium silicate, glass, stainless steel, titania, alumina, and 95% ZrO stabilized with yttrium.

52. The method of claim 47, wherein the working volume of the vessel is about 12 mL to about 33 mL.

53. The method of claim 47, wherein the volume of the dispersion is about 5 ml to about 23 mL.

54. The method of claim 47, wherein the volume of the dispersion is less than about 10 mL.

55. The method of claim 47, wherein the method further comprises maintaining substantially uniform shear between the rotor and the and the vessel.

56. The method of claim 47, wherein at the completion of the rotation period, the cosmetic product has an average particle size selected from the group consisting of less than about 500 nm, less than about 400 nm, less than about 300 nm, and less than about 100 nm.

57. The method of claim 56, wherein at least 90% of the milled cosmetic product particles have a size less than that selected from the group consisting of less than about 500 nm, less than about 400 nm, less than about 300 nm, and less than about 100 nm.

58. The method of claim 56, wherein at least 95% of the milled cosmetic product particles have a size less than that selected from the group consisting of less than about 500 nm, less than about 400 nm, less than about 300 nm, and less than about 100 nm.

59. The method of claim 56, wherein at least 99% of the milled cosmetic product particles have a size less than that selected from the group consisting of less than about 500 nm, less than about 400 nm, less than about 300 nm, and less than about 100 nm.

60. The method of claim 47, wherein the dispersion is recirculated through the vessel during rotation of the agitator.

* * * * *